US010960685B2

(12) United States Patent
Inoue et al.

(10) Patent No.: US 10,960,685 B2
(45) Date of Patent: Mar. 30, 2021

(54) IMAGE FORMING APPARATUS AND METHOD FOR CONTROLLING IMAGE FORMING APPARATUS

(71) Applicant: KYOCERA Document Solutions Inc., Osaka (JP)

(72) Inventors: Toyotsune Inoue, Osaka (JP); Hiroatsu Tamai, Osaka (JP); Takeshi Watanabe, Osaka (JP); Hiroyuki Ueda, Osaka (JP); Yasuhiro Michishita, Osaka (JP); Naoto Miyakoshi, Osaka (JP); Yusuke Takano, Osaka (JP); Noriaki Ozawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 48 days.

(21) Appl. No.: 16/668,229

(22) Filed: Oct. 30, 2019

(65) Prior Publication Data

US 2020/0139701 A1 May 7, 2020

(30) Foreign Application Priority Data

Nov. 2, 2018 (JP) ..... JP2018-207101
Nov. 2, 2018 (JP) ..... JP2018-207103

(51) Int. Cl.

| | |
|---|---|
| ***B41J 3/60*** | (2006.01) |
| ***B41J 2/21*** | (2006.01) |
| ***B41J 2/045*** | (2006.01) |

(52) U.S. Cl.
CPC ..... *B41J 3/60* (2013.01); *B41J 2/04586* (2013.01); *B41J 2/2103* (2013.01)

(58) Field of Classification Search
CPC ..... B41J 3/60; B41J 2/2103; B41J 2/04586
See application file for complete search history.

(56) References Cited

U.S. PATENT DOCUMENTS

| | | | | |
|---|---|---|---|---|
| 6,578,944 B1 | 6/2003 | Kamei et al. | ..... | 347/16 |
| 2016/0052309 A1* | 2/2016 | Taguchi | ..... | B41J 13/0045 347/16 |

FOREIGN PATENT DOCUMENTS

JP 2001-71479 A 3/2001

* cited by examiner

*Primary Examiner* — Justin Seo
(74) *Attorney, Agent, or Firm* — Stein IP, LLC

(57) ABSTRACT

A controller checks ink quantity to be ejected to a specific area on a first side (specific area ink quantity) and determines an ink quantity ratio. The specific area is a strip-shaped area including a side edge on upstream side in a conveying direction of a paper sheet on the first side. When the ink quantity ratio is larger than a reference ink quantity ratio, the controller performs a black conversion process on pixels in a conversion target range. The conversion target range is a range corresponding to the specific area in the image data of the first side. The black conversion process is a process of converting a pixel to which three color inks, i.e. cyan, magenta, and yellow inks are to be ejected into a pixel to which only black ink is to be ejected.

16 Claims, 13 Drawing Sheets

IMAGE FORMING APPARATUS AND METHOD FOR CONTROLLING IMAGE FORMING APPARATUS

INCORPORATION BY REFERENCE

This application is based upon and claims the benefit of priority from the corresponding Japanese Patent Application Nos. 2018-207101 and 2018-207103 filed Nov. 2, 2018, the entire contents of which are hereby incorporated by reference.

BACKGROUND

The present disclosure relates to an image forming apparatus that includes a line head and performs image formation (printing or drawing) using ink.

There is an image forming apparatus that performs printing using ink. The image forming apparatus using ink may cause bleed through of ink that is ejected to a paper sheet and soaks into the paper sheet. In addition, a part of the paper sheet at which ink is adhered is bulged. The bulging may cause curl or ripple (cockling). An example of an inkjet recording apparatus as described below is known, in which bleed through, curl, and ripple are taken into consideration.

An inkjet recording apparatus capable of performing duplex printing is described, in which the number of print passes in simplex printing is different from that in duplex printing with respect to the same area, i.e. the latter is larger than the former. This technique focuses attention on the fact that as the number of print passes is larger, bleed through becomes less, curl amount becomes less, and cockling amount also becomes less. The number of print passes is changed between simplex printing and for duplex printing, so that the optimal number of print passes is set for each of them.

A paper sheet absorbs ejected ink. The part absorbing ink is bulged. As a result, an edge portion of a paper sheet in a sub-scanning direction (sheet conveying direction) may be largely curled (furled). The curl occurs in the direction opposite to the bulged surface (the surface to which the ink is ejected). For instance, when the ink is ejected to the upper surface of the paper sheet, an edge portion of the paper sheet is curled downward. In general, as more ink is ejected to the edge portion of the paper sheet, the curl amount becomes more.

When performing duplex printing, the head first ejects ink to one side of the paper sheet. After printing one side, front and back sides of the paper sheet are reversed. The paper sheet after reversing front and back sides is sent back to upstream of the head. Then, the paper sheet after printing one side is conveyed to the head. The head ejects ink to the other side of the paper sheet. Thus, both sides of the paper sheet are printed.

As distance between a nozzle (head) and a paper sheet is larger, a deviation of landing position of ink becomes larger. Therefore, distance between the nozzle and the paper sheet (paper sheet conveying path) is set small. For instance, the distance is set a few millimeters or smaller. As the distance is small, there is a problem that a paper sheet may be jammed in the gap between the head and the conveying path in duplex printing, when the curl amount of the edge portion of the paper sheet after printing one side is large. When the paper sheet is jammed, it is necessary to remove the jammed paper sheet. Then, productivity of the image forming apparatus is lowered. In addition, the jammed paper sheet may damage the head.

In order to reduce bleed through or curl, the inkjet recording apparatus described above increases the number of print passes. For instance, it increases the number of print passes by four to eight times per side. This increases the number of print passes for printing one sheet in duplex printing. This may cause substantial reduction in productivity (printing speed). A problem of productivity remains.

SUMMARY

An image forming apparatus according to a first aspect of the present disclosure includes a line head, a first conveyor roller pair, a conveyor belt, a switchback roller pair, a second conveyor roller pair, a third conveyor roller pair, and a controller. The line head includes a nozzle for ejecting ink to a conveyed paper sheet and is fixed. The first conveyor roller pair conveys the paper sheet to the line head. The conveyor belt conveys the paper sheet in such a manner that the nozzle faces the paper sheet with an interval therebetween. The switchback roller pair reverses front and back sides of the paper sheet and reverses the front and rear edges of the paper sheet for duplex printing. The second conveyor roller pair conveys the paper sheet printed by the line head to the switchback roller pair. The third conveyor roller pair conveys the paper sheet switched back by the switchback roller pair so as to return the paper sheet to the first conveyor roller pair on the upstream side of the line head. A plurality of the line heads are disposed for individual ink colors. The ink colors include cyan, magenta, yellow, and black at least. In duplex printing, the controller sets one of front and back sides as a first side and sets the other side as a second side. The controller starts printing the first side first and prints the second side after the first side is printed. On the basis of image data of the first side used for printing the first side, the controller checks specific area ink quantity as ink quantity to be ejected to a specific area on the first side. The controller determines an ink quantity ratio by dividing the specific area ink quantity by a predetermined solid printing ink quantity. When the determined ink quantity ratio is larger than a predetermined reference ink quantity ratio, the controller performs a black conversion process for pixels included in a conversion target range in the image data of the first side. The specific area is a strip-shaped area including a side edge on upstream side in the conveying direction of the paper sheet on the first side, out of side edges facing each other in a sub-scanning direction, and having a width in the sub-scanning direction, which is a predetermined distance. The conversion target range is a range corresponding to the specific area in the image data of the first side. The black conversion process is a process of converting a pixel to which three color inks, i.e. cyan, magenta, and yellow inks are to be ejected into a pixel to which only black ink is to be ejected.

In addition, an image forming apparatus according to a second aspect of the present disclosure includes a line head, a first conveyor roller pair 51, a conveyor belt, a switchback roller pair, a second conveyor roller pair, a third conveyor roller pair 90, and a controller. The line head includes a nozzle for ejecting ink to a conveyed paper sheet and is fixed. The first conveyor roller pair 51 conveys the paper sheet to the line head. The conveyor belt conveys the paper sheet in such a manner that the nozzle faces the paper sheet with an interval therebetween. The switchback roller pair reverses front and back sides of the paper sheet and reverses front and rear edges of the paper sheet for duplex printing. The second conveyor roller pair conveys the paper sheet printed by the line head to the switchback roller pair. The third conveyor roller pair 90 conveys the paper sheet switched back by the switchback roller pair so that the paper sheet is returned to the first conveyor roller pair 51 on the upstream side of the line head. In duplex printing, the controller sets one of front and back sides as a first side and sets the other side as a second side. The controller starts printing the first side. On the basis of image data of the first side used for printing the first side, the controller determines first ink quantity as ink quantity to be ejected to a first area on the first side. The controller determines second ink quantity as ink quantity to be ejected to a second area as a backside area of the first area on the second side. When the first ink quantity is more than the second ink quantity, the controller controls to perform jam prevention printing. When the first ink quantity is the second ink quantity or less, the controller controls to perform normal duplex printing. When performing the jam prevention printing, the controller determines an absolute value of a difference between the first ink quantity and the second ink quantity. In printing the first side first time, the controller controls the line head to print the first area by the same ink quantity as the absolute value. The controller controls the switchback roller pair to switchback the paper sheet after printing the first side. The controller controls to return the switched-back paper sheet to upstream side of the line head. Next, the controller controls the line head to print the entire second side. The controller controls the switchback roller pair to switchback the paper sheet after printing the second side. The controller controls to return the switched-back paper sheet to upstream side of the line head. Next, the controller controls the line head to print the remaining area on the first side. The first area is a strip-shaped area including a side edge on upstream side in the conveying direction of the paper sheet when printing the first side out of side edges facing each other in the sub-scanning direction, and having a width in the sub-scanning direction, which is a predetermined distance.

DETAILED DESCRIPTION

The present disclosure describes prevention of paper sheet jamming at a head due to curl in duplex printing, while maintaining productivity. With reference to FIGS. 1 to 10, one example of an image forming apparatus according to an embodiment of the present disclosure is described below. In addition, with reference to FIGS. 11 to 17, one example of an image forming apparatus according to a variation of the present disclosure is described. A printer 100 is exemplified as the image forming apparatus for description. The printer 100 is an inkjet type. Note that the printer 100 may be a multifunction peripheral including a scanner, for example.

(Outline of Printer 100)

Figure 1:
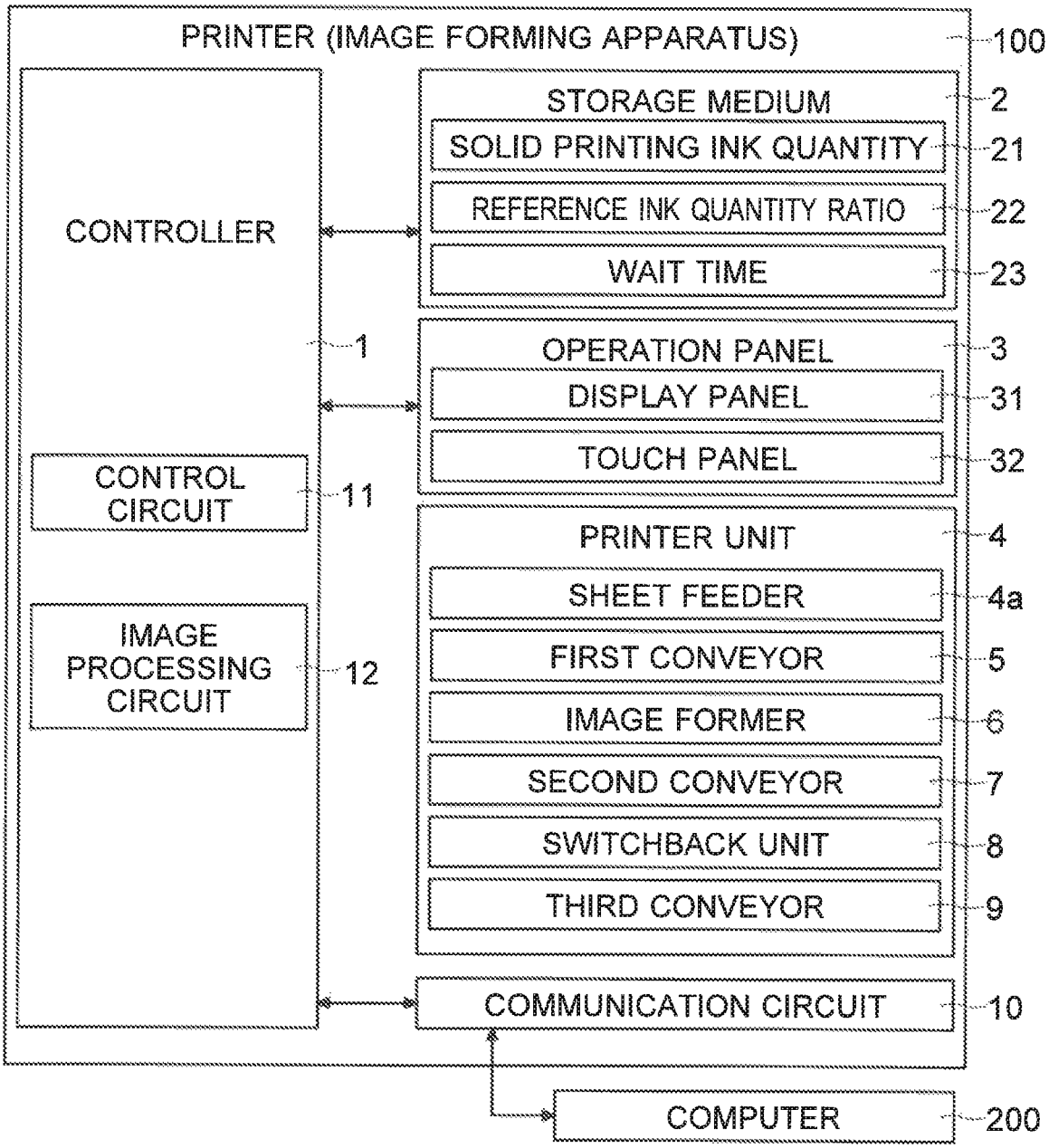
FIG. 1 is a diagram showing an example of a printer according to an embodiment.
Figure 2:
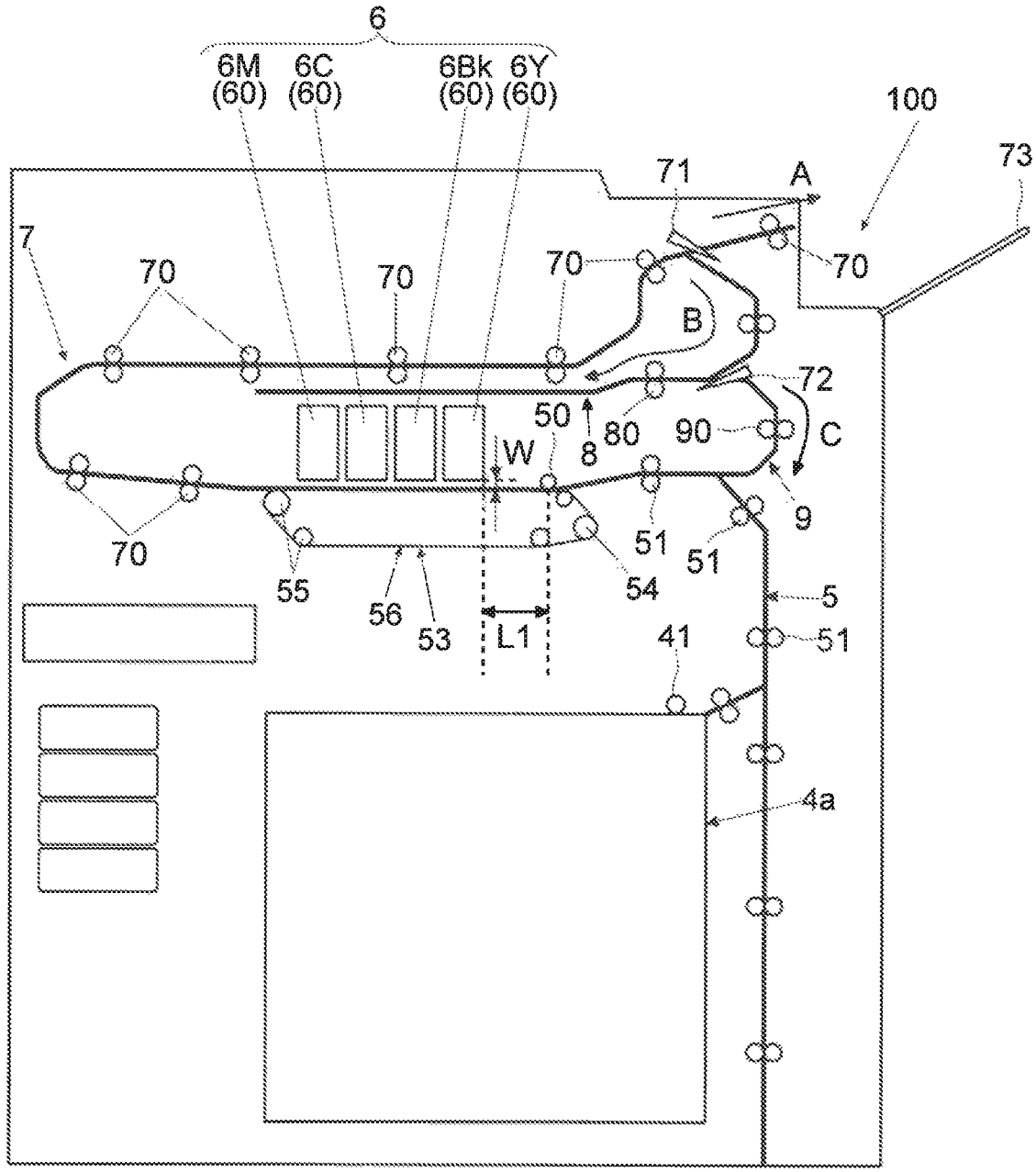
FIG. 2 is a diagram showing an example of the printer according to the embodiment.

First, with reference to FIGS. 1 and 2, outline of the printer 100 according to the embodiment and the variation is described. The printer 100 includes a controller 1, a storage medium 2, an operation panel 3, a printer unit 4, and a communication circuit 10. The controller 1 controls individual portions of the printer 100. The controller 1 includes a control circuit 11 and an image processing circuit 12. The control circuit 11 is a CPU, for example. The control circuit 11 performs calculation and processing on the basis of a control program and control data stored in the storage medium 2. The storage medium 2 includes a nonvolatile storage device such as a ROM or a storage (such as an HDD or a flash ROM), and a volatile storage device such as a RAM.

The operation panel 3 includes a display panel 31 and a touch panel 32. The display panel 31 displays setting screens and information. The controller 1 controls the display panel 31 to display images for operation such as keys, buttons, and tabs. The touch panel 32 detects a touch operation to the display panel 31. On the basis of an output from the touch panel 32, the controller 1 recognizes an image for operation that is operated. The controller 1 recognizes a setting operation performed by a user.

The printer 100 includes the printer unit 4. The controller 1 controls operation of the printer unit 4. The printer unit 4 includes a sheet feeder **4*a*, a first conveyor 5, an image former 6, a second conveyor 7, a switchback unit 8, and a third conveyor 9, The sheet feeder 4*a* stores a stack of paper sheets. The sheet feeder 4*a* includes a sheet feed roller 41. The sheet feed roller 41 contacts the uppermost paper sheet of the stack of paper sheets stored in the sheet feeder 4*a*. A sheet feed motor (not shown) is provided for driving the sheet feed roller 41 to rotate. In a print job, the controller 1 controls the sheet feed motor to rotate so as to drive the sheet feed roller 41 to rotate. In this way, the sheet feeder 4*a* feeds a paper sheet to the first conveyor 5**.

The first conveyor 5 conveys the paper sheet. The controller 1 controls the first conveyor 5 to convey the paper sheet fed from the sheet feeder 4*a* to the image former 6. In FIG. 2, paper sheet conveying paths are shown by thick lines. Along the conveying paths, a conveying rotation body 50 and a plurality of first conveyor roller pairs 51 are disposed. The conveying rotation body 50 is a roller. A first conveying motor (not shown) is disposed for driving these rotating bodies to rotate. In the print job, the controller 1 controls the first conveying motor to rotate so as to drive the conveying rotation body 50 and the first conveyor roller pairs 51 to rotate.

The first conveyor 5 includes a conveyor unit 53. The conveyor unit 53 includes a driving roller 54, a plurality of driven rollers 55, and a conveyor belt 56. The conveyor belt 56 is stretched around the driving roller 54 and the driven rollers 55. In the print job, the controller 1 controls a belt motor to rotate. The belt motor drives the driving roller 54 to rotate. As a result, the paper sheet fed from the sheet feeder 4*a* is conveyed on the conveyor belt 56. Note that the conveyor unit 53 includes a suction unit. The suction unit sucks the paper sheet on the conveyor belt 56 by sucking air or using electrostatic force. The suction unit fixes position of the paper sheet and distance between each nozzle and the paper sheet. When performing printing, the controller 1 controls the suction unit to work.

The image former 6 ejects ink to the conveyed paper sheet so as to record an image. The image former 6 includes a plurality of line heads 60. Specifically, the printer 100 includes four line heads 60 (6Bk, 6C, 6M, and 6Y). The line head 6Bk ejects black ink. The line head 6C ejects cyan ink. The line head 6M ejects magenta ink. The line head 6Y ejects yellow ink.

The line heads 60 are disposed above the conveyor belt 56. Position of each line head 60 is fixed. Each line head 60 includes a plurality of nozzles. The nozzles are arranged in a main scanning direction (a direction perpendicular to the conveying direction). Each nozzle ejects ink to the conveyed paper sheet. An opening of each nozzle faces the conveyor belt 56. When performing printing, the first conveyor 5 conveys the paper sheet to the line heads 60 and conveys the paper sheet in such a manner facing the nozzle.

An interval W (gap) is formed between each line head 60 and the conveyor belt 56 (see FIG. 2). The paper sheet enters into this interval W. The interval W has a predetermined value. The interval W is approximately 1 to a few millimeters, for example. The ink ejected from the nozzle lands on the conveyed paper sheet. In this way, an image is recorded (formed). Note that an ink tank for supplying ink is disposed for each line head 60.

The controller 1 controls the second conveyor 7 to convey the paper sheet after passing the line heads 60. The second conveyor 7 conveys the paper sheet to the discharge tray 73 or to the switchback unit 8. The second conveyor 7 includes a plurality of second conveyor roller pairs 70, a first switching guide 71, and a second switching guide 72. A second conveying motor (not shown) is disposed to drive the second conveyor roller pairs 70 to rotate. The first switching guide 71 and the second switching guide 72 are guide plates for switching the paper sheet conveying path. The first switching guide 71 guides the paper sheet to the discharge tray 73 or to the switchback unit 8. A first switching motor (not shown) is disposed to drive the first switching guide 71 to swing. The second switching guide 72 guides the paper sheet to the switchback unit 8 or to the first conveyor 5 (upstream of the image former 6). A second switching motor (not shown) is disposed to drive the second switching guide 72 to swing.

The switchback unit 8 includes a switchback roller pair 80. For duplex printing, the controller 1 controls the switchback unit 8 to reverse front and back sides of the paper sheet and to reverse front and rear edges of the paper sheet.

The third conveyor 9 conveys the paper sheet switched back by the switchback unit 8. The third conveyor 9 includes the third conveyor roller pair 90. A third conveying motor (not shown) is disposed to drive the third conveyor roller pair 90 to rotate. The controller 1 controls the third conveyor 9 to convey the switched-back paper sheet. The third conveyor 9 returns the switched-back paper sheet to upstream side of the line head 60. The third conveyor 9 allows the switched-back paper sheet to join the first conveyor 5.

The controller 1 is connected to the communication circuit 10. The communication circuit 10 includes communication hardware (a connector, a communication control circuit, and a communication memory). The communication memory stores communication software. The communication circuit 10 communicates with a computer 200. The computer 200 is a PC or a server, for example. The controller 1 receives print data from the computer 200. The print data includes print setting information and data described in page description language, for example. The print setting information is information for setting a print job. The print setting performed by a user with the computer 200 is included in the print setting information. For instance, when setting is performed with the computer 200 to perform duplex printing, the print data includes the print setting information indicating to perform duplex printing.

The controller 1 (the image processing circuit 12) analyzes data described in page description language included in the print data. On the basis of the data described in page description language, the controller 1 generates print image data (raster data), The controller 1 performs image processing on the basis of the print image data. Finally, the controller 1 performs image processing such as halftone processing and generates image data for ink ejection. The image data for ink ejection is data indicating nozzle positions to eject ink and ejection timings. On the basis of the image data for ink ejection, the controller 1 controls the line head 60 to eject ink for each line.

(Process of Simplex Printing)

Figure 3:
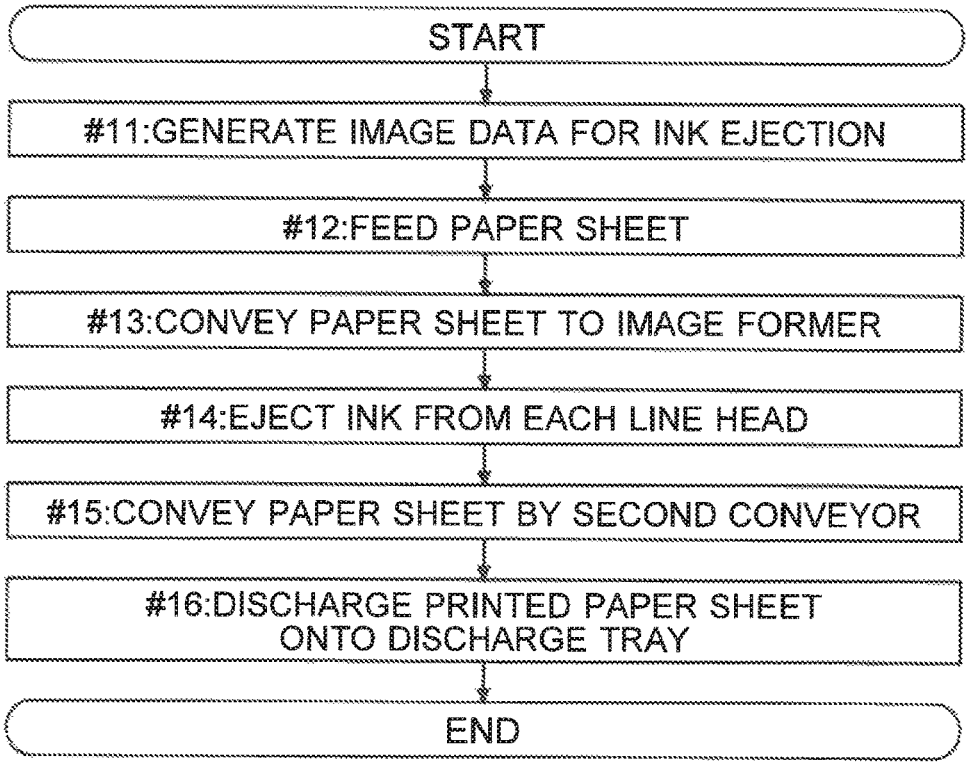
FIG. 3 is a diagram showing an example of a process flow in simplex printing by the printer according to the embodiment.

Next, with reference to FIG. 3, one example of a process flow of simplex printing by the printer 100 according to the embodiment and the variation is described. Note that when printing successively on a plurality of paper sheets, the controller 1 may perform the process of FIG. 3 in parallel.

First, on the basis of the received print data, the controller 1 generates the image data for ink ejection for a page to be printed (Step #11). Next, the controller 1 controls the sheet feeder 4*a* to feed the paper sheet (Step #12). In this way, the paper sheet is fed from the sheet feeder 4*a*. Next, the controller 1 controls the first conveyor 5 to convey the paper sheet to the image former 6 (Step #13). When the paper sheet reaches the image former 6, the controller 1 controls each line head 60 to eject ink on the basis of the generated image data for ink ejection (Step #14). By ink ejection from each line head 60, printing (drawing) on one side of the paper sheet is completed.

Then, the controller 1 controls the second conveyor 7 to convey the paper sheet to the discharge tray 73 (Step #15). At this time, the controller 1 controls the plurality of second conveyor roller pairs 70 to rotate. In addition, the controller 1 controls the first switching guide 71 to swing so that the paper sheet is discharged onto the discharge tray 73. In other words, the controller 1 controls the first switching guide 71 to close the passage to the switchback unit 8. Finally, the second conveyor 7 discharges the printed paper sheet onto the discharge tray 73 (Step #16, discharge in direction A in FIG. 2). In this way, simplex printing of one page paper sheet is completed (END).

(Setting of First and Second Sides)

Figure 4:
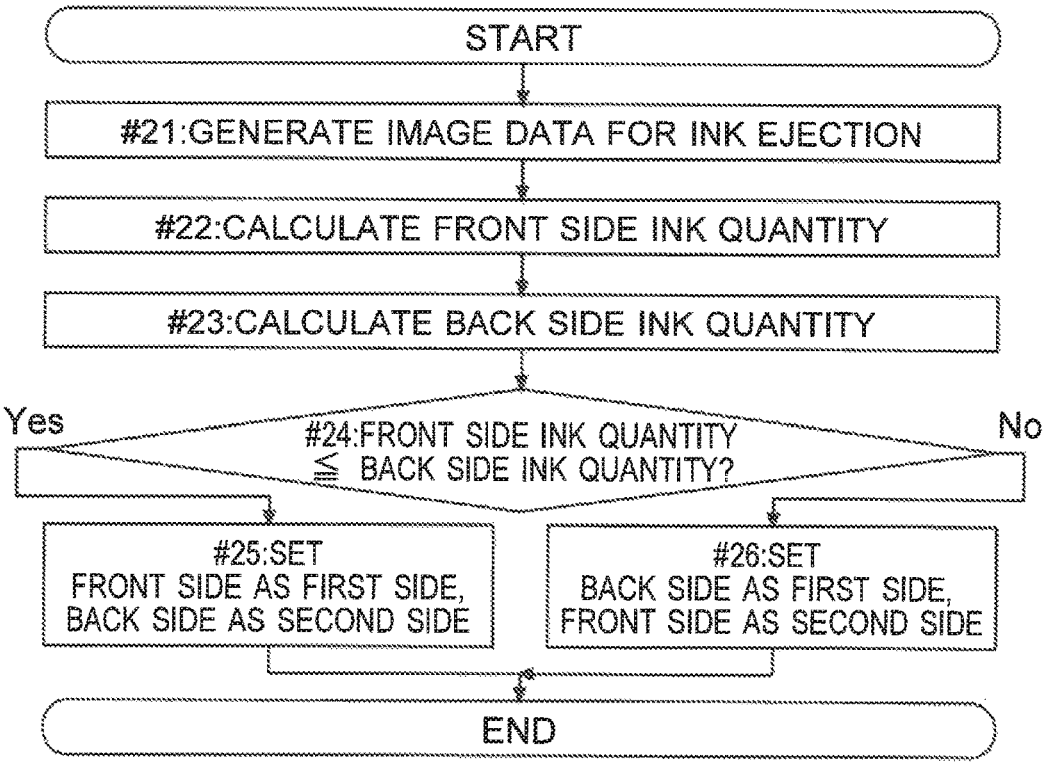
FIG. 4 is a diagram showing an example of a setting flow for first and second sides in duplex printing by the printer according to the embodiment.

Next, one example of a setting flow for first and second sides in duplex printing by the printer 100 according to the embodiment is described with reference to FIGS. 4 and 5. The flow of FIG. 4 starts when duplex printing is started on the basis of the received print data. In this case, the print data includes print setting information defining that duplex printing is to be performed. The controller 1 analyzes the print setting information and recognizes that duplex printing is to be performed.

First, the controller 1 generates image data for ink ejection of each page of front and back sides on the basis of the received print data (Step #21). In duplex printing, the print data includes front side page data described in page description language and back side page data described in page description language. The controller 1 (the image processing circuit 12) generates print image data (raster data) for each of front side and back side pages. Further, the controller 1 generates image data for ink ejection for each of front side and back side pages. In color printing, the controller 1 generates image data for ink ejection of C, M, Y, and Bk colors for the front side. In addition, the controller 1 generates image data for ink ejection of C, M, Y, and Bk colors for the back side, too.

Next, on the basis of the image data for ink ejection of the first page front side, the controller 1 determines front side ink quantity (Step #22). On the basis of the image data for ink ejection of the first page back side, the controller 1 determines back side ink quantity (Step #23). The front side ink quantity is quantity of ink to be ejected to a front side edge area F1 on the front side. In addition, the back side ink quantity is quantity of ink to be ejected to a back side edge area F2 on the back side.

Figure 5:
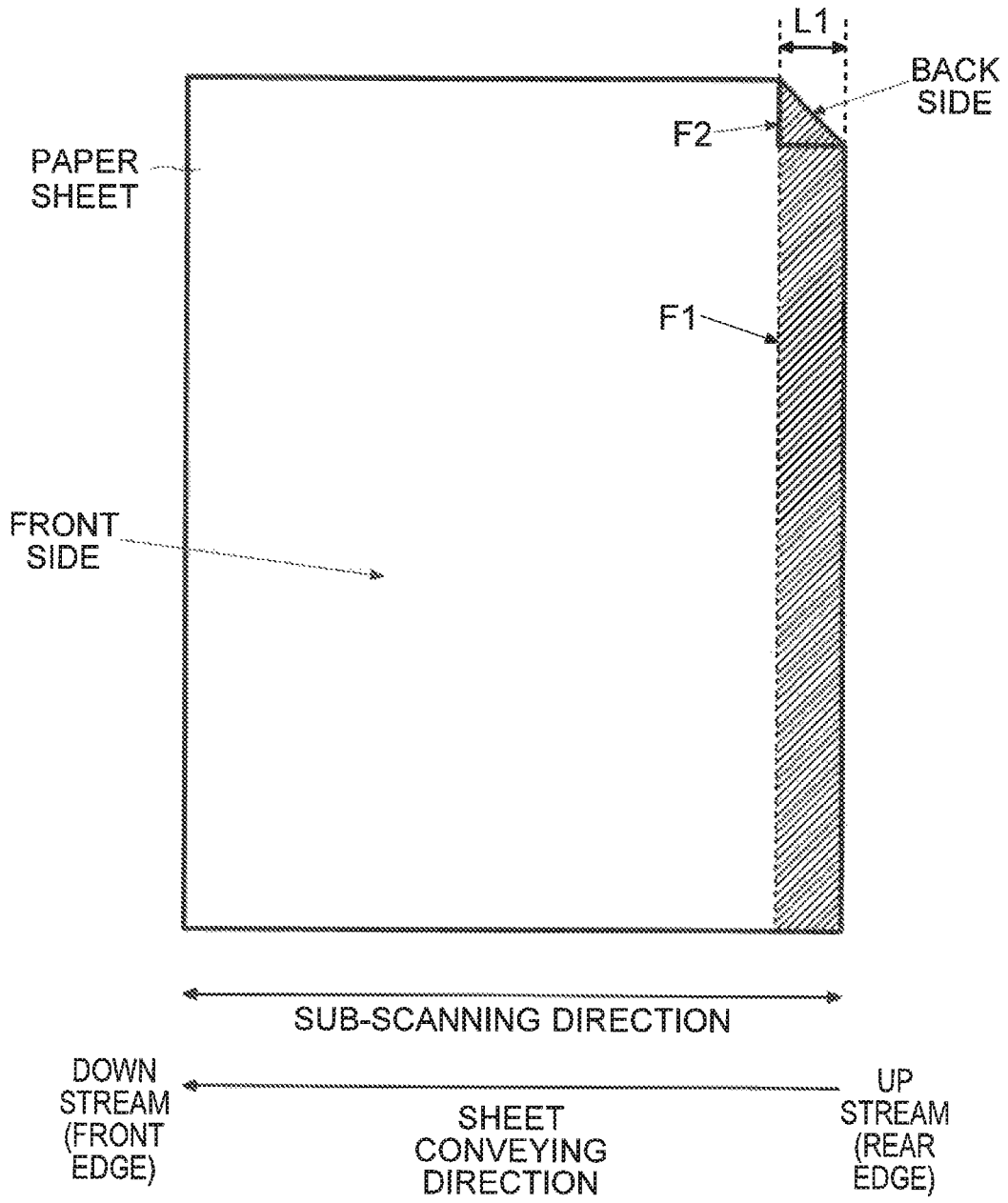
FIG. 5 is a diagram showing an example of a front side edge area and a back side edge area according to the embodiment.
Figure 6:
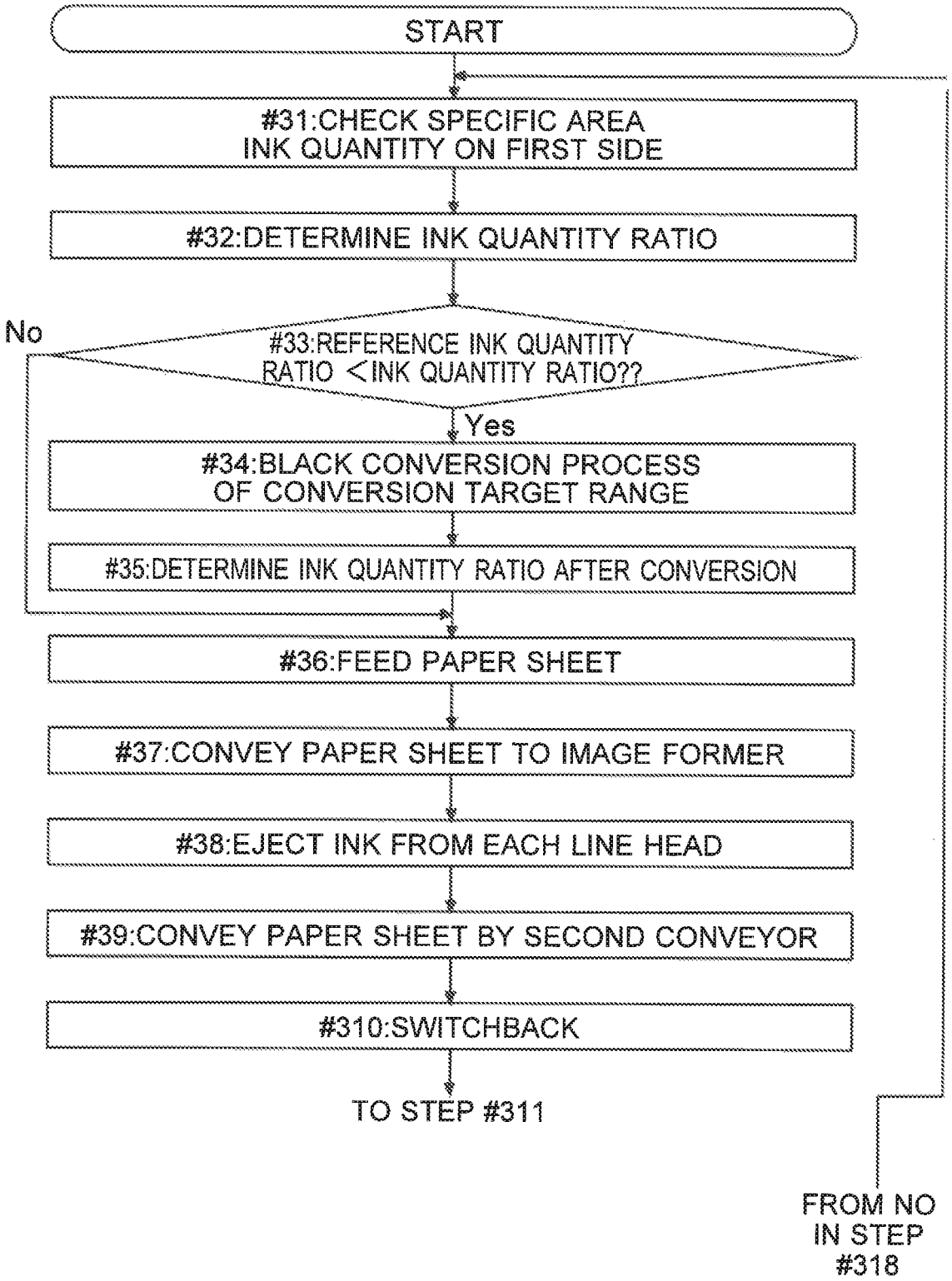
FIG. 6 is a diagram showing an example of a process flow in duplex printing by the printer according to the embodiment.
Figure 7:
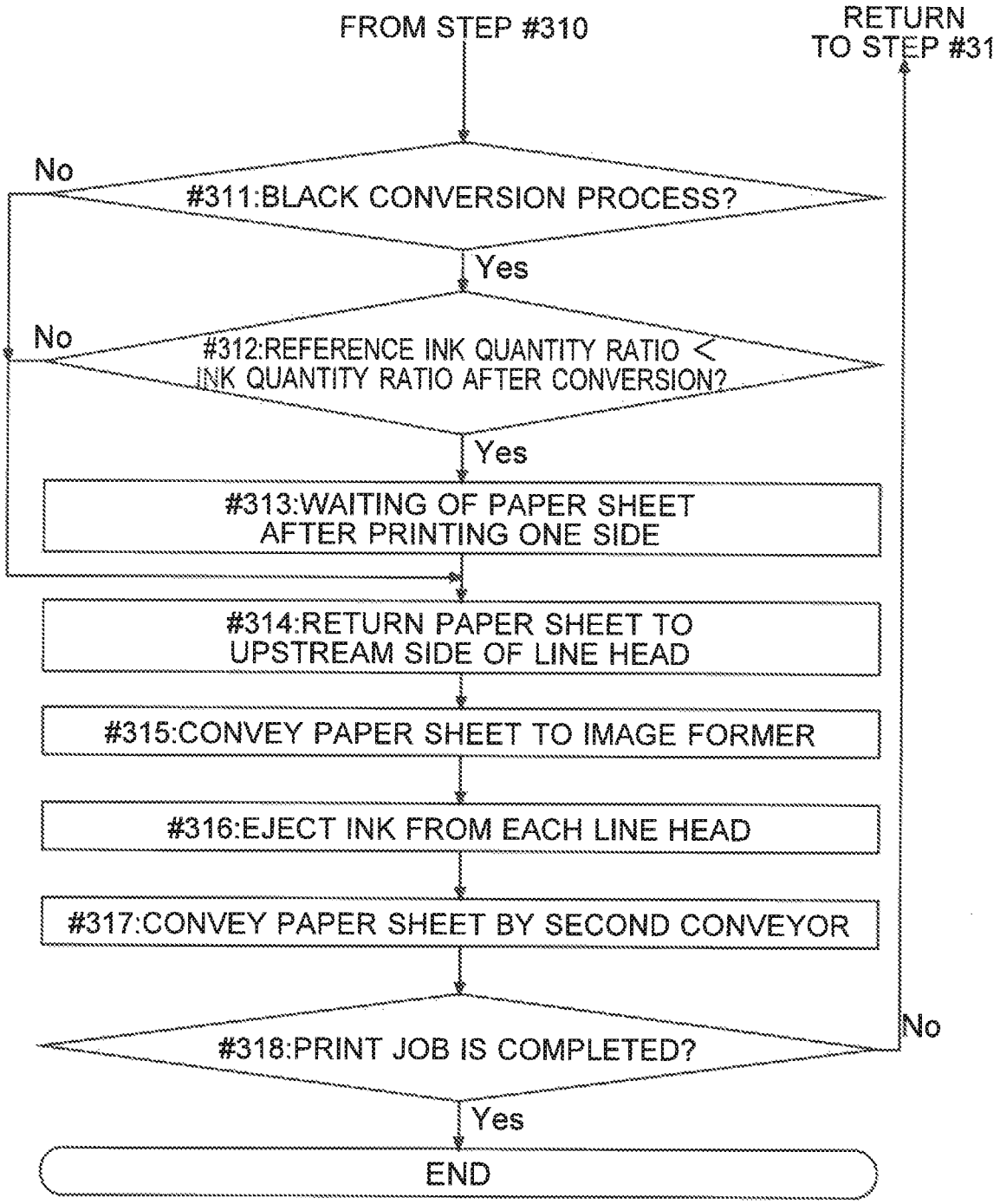
FIG. 7 is a diagram showing an example of a process flow in duplex printing by the printer according to the embodiment.

As shown in FIG. 5, the front side edge area F1 includes a side edge on upstream side in the sheet conveying direction (rear edge side) out of side edges facing each other in the sub-scanning direction. The upstream side in the sheet conveying direction (rear edge side) is upstream side when printing the front side. When printing the back side by switchback, the front side edge area F1 becomes the downstream side in the sheet conveying direction (front edge side). The front side edge area F1 has a width in the sub-scanning direction, which is a predetermined distance L1. The front side edge area F1 is a strip-shaped area. As shown in FIG. 5, the back side edge area F2 is a backside area of the front side edge area F1. The front side edge area F1 and the back side edge area F2 have the same area size.

Further, the predetermined distance L1 may be the same as a sheet conveying distance between the roller closest to the line head 60 on the most upstream side in the sheet conveying direction (the conveying rotation body 50) and the line head 60 on the most upstream side in the sheet conveying direction. In other words, the predetermined distance L1 may be a sheet conveying distance between the conveying rotation body 50 and the line head 60 on the most upstream side. In FIG. 2, the sheet conveyor roller closest to the line head 60 is denoted by 50. In FIG. 2, the predetermined distance L1 is a distance between the conveying rotation body 50 and a side surface of the line head 60 on the most upstream side in the sheet conveying direction, the side surface being parallel to the main scanning direction. In this way, the predetermined distance L1 may be a distance from the nip between the conveying rotation body 50 and the conveyor belt 56 to a start point of the interval W between the conveyor belt 56 and the line head 6Y in the sheet conveying direction.

Calculation of the front side ink quantity and the back side ink quantity is described. First, quantity of ink to be ejected to one pixel is determined in advance for each color. Further, in the printer 100 of this embodiment, the quantity of ink to be ejected to one pixel is the same (or may be different) among colors. For instance, the quantity of ink to be ejected to one pixel is approximately 5 to 7.5 picolitters for each color.

The controller 1 counts the number of pixels to eject ink for each color in the area corresponding to the front side edge area F1 in the image data for ink ejection of the front side. The controller 1 determines the number of pixels to eject ink for each of cyan, yellow, magenta, and black inks. The controller 1 determines the sum of the numbers of pixels of individual colors. The controller 1 multiplies quantity of ink to be ejected to one pixel of one color and the determined sum, so as to calculate the front side ink quantity (Step #22).

In addition, the controller 1 counts the number of pixels to eject ink for each color in the area corresponding to the back side edge area F2 in the image data for ink ejection of the back side. The controller 1 determines the number of pixels to eject ink for each of cyan, yellow, magenta, and black inks. The controller 1 determines the sum of the numbers of pixels of individual colors. The controller 1 multiplies quantity of ink to be ejected to one pixel of one color and the determined sum, so as to calculate the back side ink quantity (Step #23).

Next, the controller 1 checks whether or not the front side ink quantity is the back side ink quantity or less (Step #24). In other words, the controller 1 checks which one of the front side edge area F1 and the back side edge area F2 has more ink ejection quantity.

When the front side ink quantity is the back side ink quantity or less (Yes in Step #24), the controller 1 sets the front side as a first side and sets the back side as a second side (Step #25). On the contrary, when the front side ink quantity is more than the back side ink quantity (No in Step #24), the controller 1 sets the back side as the first side and sets the front side as the second side (Step #26), When Step #25 or Step #26 is performed, this flow is finished (END). The controller 1 sets one of the front and back sides as the first side and sets the other side as the second side. After that, the controller 1 starts printing the first side of each paper sheet, and prints the second side after the first side is printed. In this way, the controller 1 determines which one of the front and back sides should be printed first.

Note that in a print job of performing duplex printing a plurality of paper sheets successively, when the front side of the first sheet is set as the first side, the controller 1 sets the front side of every page as the first side. When the back side of the first sheet is set as the first side, the controller 1 sets the back side of every page as the first side. In this way, the discharged paper sheets have sorted front and back sides in all pages.

(Flow of Duplex Printing)

Next, with reference to FIGS. 6 to 10, one example of flow of duplex printing by the printer 100 according to the embodiment is described. After setting the first and second sides, the controller 1 checks specific area ink quantity as ink quantity for a specific area (Step #31). Here, the specific area includes a side edge on upstream side in the sheet conveying direction (rear edge side) of the paper sheet out of side edges facing each other in the sub-scanning direction. The upstream side in the sheet conveying direction (rear edge side) means upstream side when printing the first side. The specific area has a width in the sub-scanning direction, which is the predetermined distance L1. The specific area is a strip-shaped area.

When the front side is the first side, the front side edge area F1 corresponds to the specific area. When the back side is the first side, the specific area includes a side edge on upstream side in the sheet conveying direction (rear edge side) when printing the back side, out of side edges facing each other in the sub-scanning direction. When the back side is the first side, the upstream side in the sheet conveying direction (rear edge side) is the upstream side when printing the back side.

When the front side is the first side, the controller 1 sets the front side ink quantity as the specific area ink quantity. When the back side is the first side, the controller 1 counts the number of pixels to eject ink for each color in the area corresponding to the specific area in the image data for ink ejection of the back side. The controller 1 determines the number of pixels to eject ink for each of cyan, yellow, magenta, and black inks. The controller 1 determines the sum of the numbers of pixels of individual colors. The controller 1 multiplies the quantity of ink to be ejected to one pixel of one color and the determined sum, so as to calculate the specific area ink quantity (Step #31).

Further, the controller 1 calculates an ink quantity ratio (Step #32). The controller 1 calculates the ink quantity ratio by dividing the specific area ink quantity by solid printing ink quantity 21. The solid printing ink quantity 21 is determined in advance. The storage medium 2 stores the solid printing ink quantity 21 in a nonvolatile manner (see FIG. 1). The controller 1 performs the calculation using the solid printing ink quantity 21 stored in the storage medium 2.

The solid printing ink quantity 21 is ink quantity when ejecting ink to all pixels of all colors in the specific area. In other words, the solid printing ink quantity 21 is ink consumption quantity when ejecting C, M, Y, and Bk inks to all pixels in the specific area. The number of all pixels in the specific area, the ink ejection quantity to one pixel of one color, and 4 (4 colors) are multiplied, and thus the solid printing ink quantity 21 can be calculated (ink quantity 400%). The ink quantity ratio indicates a ratio of ink quantity in the specific area to ink quantity when performing 4-color solid printing.

Further, the controller 1 checks whether or not the determined ink quantity ratio is more than a reference ink quantity ratio 22 (Step #33). The reference ink quantity ratio 22 is an ink quantity ratio when the paper sheet curl amount becomes the same as the interval W between the line head 60 (nozzle) and the conveyor belt 56 (paper sheet). The reference ink quantity ratio 22 is determined in advance. The storage medium 2 stores the reference ink quantity ratio 22 in a nonvolatile manner. The controller 1 refers to the reference ink quantity ratio 22 stored in the storage medium 2.

Figure 8:
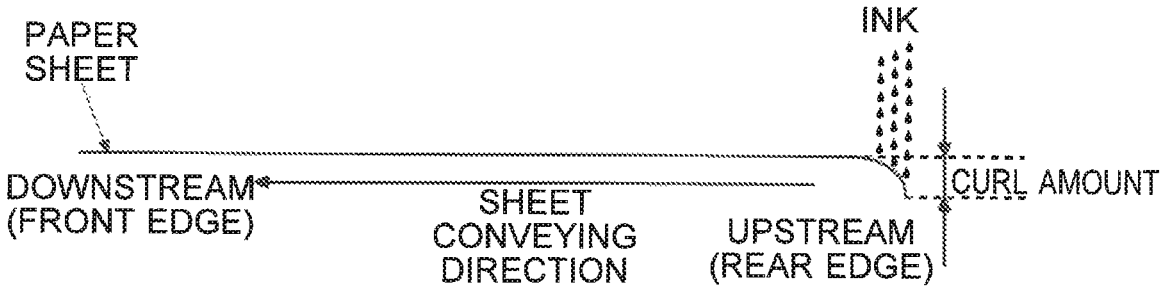
FIG. 8 is a diagram showing an example of paper sheet curl.

First, with reference to FIG. 8, paper sheet curl is described. The ink is ejected to the paper sheet. The paper sheet absorbs the ejected ink. A part that absorbed ink is bulged. When expansion rate is different between one side and the other side of the paper sheet, the paper sheet is curled. FIG. 8 shows an example in which the ink is ejected to the upper surface. For instance, when the ink is ejected to the upper surface on the upstream side in the sheet conveying direction, the upstream side edge of the paper sheet is curled (curved) downward.

Figure 9:
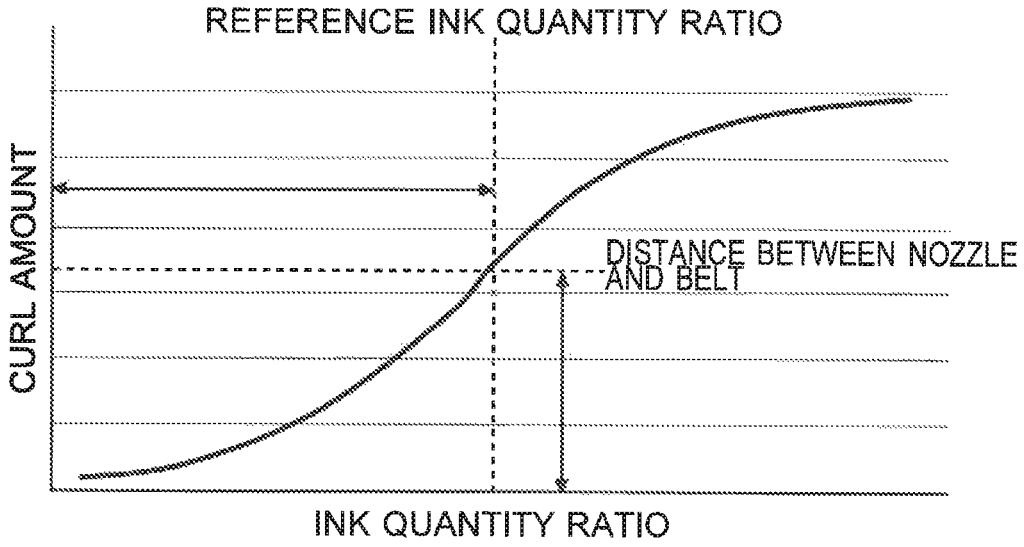
FIG. 9 is a diagram showing an example of curl amount with respect to an ink quantity ratio.

The curl amount is a sag amount of a paper sheet edge. The curl amount is a lift amount (height) of the paper sheet edge in a state where the curled part is curled upward. It can also be said that the curl amount is a distance between the paper sheet edge and the horizontal surface in the vertical direction when the paper sheet is placed on the horizontal surface. Further, as shown in FIG. 9, as more ink is ejected to the specific area, the curl amount becomes more. It is because more liquid is absorbed by the paper sheet so that an expansion degree is increased.

Here, one example of the reference ink quantity ratio 22 is shown by broken lines in FIG. 9. By repeating experiment, it is possible to check the ink quantity ratio at which the curl amount becomes equal to the interval W between the line head 60 (nozzle) and the conveyor belt 56 (paper sheet). When duplex printing is performed when the ink quantity ratio is equal to the reference ink quantity ratio 22, probability of occurrence of jamming of the paper sheet at the line head 60 is increased. The reference ink quantity ratio 22 becomes a reference for determining whether or not the paper sheet is jammed at the line head 60.

When the determined ink quantity ratio is larger than the reference ink quantity ratio 22 (Yes in Step #33), the controller 1 performs a black conversion process for pixels included in a conversion target range in the image data of the first side (image data for ink ejection of the first side) (Step #34). The conversion target range is the range corresponding to the specific area in the image data for ink ejection of the first side.

On the contrary, when the determined ink quantity ratio is the reference ink quantity ratio 22 or smaller (No in Step #33), the controller 1 skips Step #34 and Step #35. In other words, the controller 1 does not perform the black conversion process for pixels in the conversion target range.

The black conversion process is a process of converting a pixel to which three color inks, i.e. cyan, magenta, and yellow inks are to be ejected into a pixel to which only black ink is to be ejected. When reproducing black color, cyan, magenta, and yellow inks may be superimposed at one pixel. The pixel at which cyan, magenta, and yellow inks are to be superimposed is converted into a pixel to which only black ink is to be ejected. Specifically, the controller 1 converts a pixel at which three color inks, i.e. cyan, magenta, and yellow inks are superimposed in the image data for cyan, magenta, and yellow ink ejection into a non-ejection pixel (white). In addition, the controller 1 converts a pixel in the image data for black ink ejection, at the same position as the pixel converted into the non-ejection pixel, into an ejection pixel (black). In this way, ink quantity to be used for this pixel is reduced to ⅓. By performing the black conversion process, curl amount in the specific area can be reduced.

Here, the controller 1 (image processing circuit 12) may convert every pixel in the conversion target range, to which three color inks, i.e. cyan, magenta, and yellow inks are ejected into a pixel to which only black ink is to be ejected (first method). In this case, the controller 1 reduces ink quantity to be ejected to the specific area as much as possible.

In addition, the controller 1 (image processing circuit 12) may convert pixels to which three color inks, i.e. cyan, magenta, and yellow inks are to be ejected in the conversion target range into pixels to which only black ink is to be ejected, so that the ink quantity ratio becomes the reference ink quantity ratio 22 or smaller (second method). In the second black conversion method, a target ink quantity ratio is determined in advance. The target ink quantity ratio may be a reference ink quantity ratio 22. Alternatively, the target ink quantity ratio may be smaller than the reference ink quantity ratio 22.

For instance, the controller 1 calculates an absolute value of a difference between the determined ink quantity ratio and the target ink quantity ratio. The controller 1 multiplies the absolute value and the solid printing ink quantity 21 so as to calculate a reduction target value. The reduction target value indicates ink quantity to be reduced so that the ink quantity ratio becomes the target ink quantity ratio. Dividing the reduction target value by decreased amount of ink used for one pixel after the black conversion process, the controller 1 can determine the number of pixels for which the black conversion process should be performed. The controller 1 performs the black conversion process for the determined number of pixels for which the black conversion process should be performed. Note that, when the number of pixels for which the black conversion process can be performed is smaller than the number of pixels for which the black conversion process should be performed, the controller 1 performs the black conversion process for all pixels for which the black conversion process can be performed.

Alternatively, the controller 1 (image processing circuit 12) may convert pixels of a predetermined conversion number (upper limit number) out of pixels to which three color inks, i.e. cyan, magenta, and yellow inks are to be ejected in the conversion target range, into pixels to which only black ink is to be ejected (third method). The black conversion process may change tint or color shade of the image. By setting the upper limit conversion number, change in tint or color shade of the image can be reduced.

The operation panel 3 may accept selection of the black conversion process to be used from the first to third methods. In this case, the controller 1 (image processing circuit 12) performs the selected black conversion process.

When the black conversion process is performed, the controller 1 determines ink quantity ratio after conversion on the basis of the image data of the first side (image data for ink ejection of the first side) after the conversion (Step #35). Specifically, the controller 1 determines ink quantity after conversion as ink quantity to be ejected to the specific area. The controller 1 counts the number of pixels to eject ink for each color in the area corresponding to the specific area in the image data for ink ejection of the first side after the conversion. The controller 1 determines the number of pixels to eject ink for each of cyan, yellow, magenta, and black inks. The controller 1 determines the sum of the numbers of pixels of individual colors. The controller 1 multiplies the quantity of ink to be ejected to one pixel of one color and the determined sum, so as to calculate the ink quantity after conversion. Further, the controller 1 divides the determined ink quantity after conversion by the solid printing ink quantity 21, so as to calculate the ink quantity ratio after conversion.

Next, the controller 1 controls the sheet feeder 4*a* to feed the paper sheet (Step #36). In this way, the paper sheet is fed from the sheet feeder 4*a*. Next, the controller 1 controls the first conveyor 5 to convey the paper sheet to the image former 6 (Step #37). When the paper sheet reaches the image former 6, the controller 1 controls each head 60 to perform ink ejection on the basis of the image data for ink ejection of the first side (Step #38). After each line head 60 performs ink ejection, printing (drawing) on one side of the paper sheet is completed.

Further, the controller 1 controls the second conveyor 7 to convey the paper sheet to the switchback unit 8 (Step #39). The controller 1 allows the paper sheet to enter the switchback unit 8. The controller 1 controls the plurality of second conveyor roller pairs 70 to rotate. In addition, the controller 1 controls the first switching guide 71 to swing to the position for sending the paper sheet to the switchback unit 8. In other words, the controller 1 controls the first switching guide 71 to open the passage to the switchback unit 8. In addition, the controller 1 controls the second switching guide 72 to swing so that the paper sheet can enter the switchback unit 8. As a result, the paper sheet is conveyed in direction B in FIG. 2.

Further, the controller 1 controls the switchback unit 8 to perform the switchback operation (Step #310). First, the controller 1 controls the switchback roller pair 80 to rotate so that the paper sheet enters to the back of the switchback unit 8. Further, the controller 1 stops the switchback roller pair 80 before the paper sheet pass a nip between the switchback roller pair 80. When the rear edge of the paper sheet passes a branch point of the second conveyor 7, the switchback unit 8, and the third conveyor 9, the controller 1 stops the switchback roller pair 80. In this way, in the following conveyance, an edge in the specific area of the paper sheet becomes the downstream side in the sheet conveying direction (front edge side). The edge in the specific area first enters the line head 60 (the interval W).

Further, the controller 1 checks whether or not the black conversion process has been performed (Step #311). When the black conversion process has been performed (Yes in Step #311), the controller 1 checks whether or not the ink quantity ratio after conversion is larger than the reference ink quantity ratio 22 (Step #312). When the ink quantity ratio after conversion is larger than the reference ink quantity ratio 22 (Yes in Step #312), the controller 1 allows the paper sheet after printing one side to wait at the switchback unit 8 for a predetermined wait time 23 (Step #313).

Figure 10:
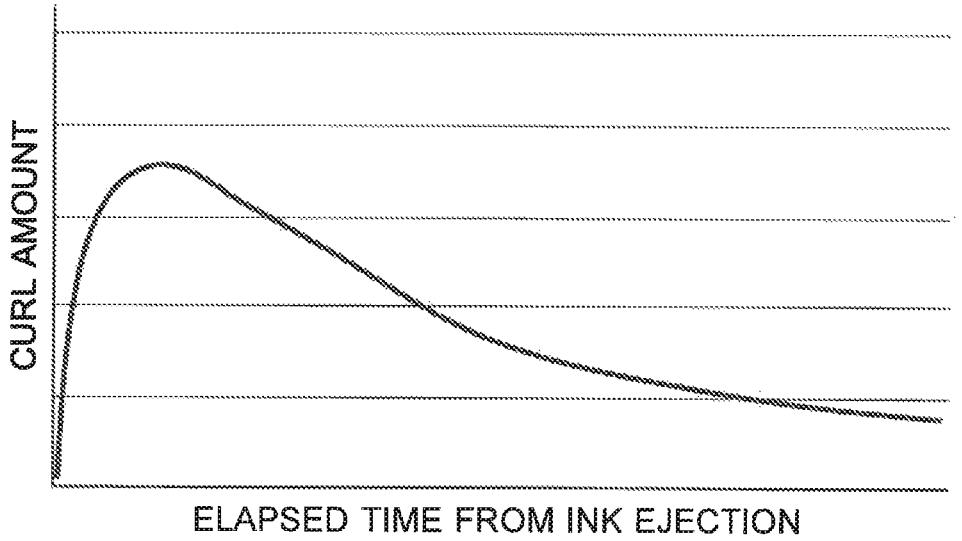
FIG. 10 is a diagram showing an example of curl amount variation with respect to time from ink ejection.

As shown in FIG. 10, there is a tendency that as elapsed time from ink ejection becomes longer, the curl amount of the paper sheet edge becomes smaller. It may be possible to avoid paper sheet jamming at the line head 60 by delaying entrance of the switched-back paper sheet to the line head 60 after ink ejection to the first side. The storage medium 2 stores the wait time 23 in a nonvolatile manner. The controller 1 refers to the wait time 23 stored in the storage medium 2. The wait time 23 can be determined appropriately. It may be possible to determine a plurality of sets of the wait time 23. For instance, as the ink quantity ratio after conversion is larger, the wait time 23 may be defined longer. In addition, when the ink is ejected to the specific area by the solid printing ink quantity 21, the time required for the curl amount in the specific area to become the interval W between the nozzle and the conveyor belt 56 or less may be defined as the wait time 23.

After waiting of the paper sheet after printing one side (Step #313), the controller 1 returns the paper sheet (after printing one side) to the upstream side of the line head 60 (Step #314). In addition, when the black conversion process is not performed (No in Step #311), or when the ink quantity ratio after conversion is not larger than the reference ink quantity ratio 22 (No in Step #312), the controller 1 returns the paper sheet (after printing one side) to the upstream side of the line head 60 without waiting (without setting the wait time 23) (Step #314).

The controller 1 controls the second switching guide 72 to swing to angle for guiding the paper sheet to the first conveyor 5 (to the upstream of the image former 6). In addition, the controller 1 controls the switchback roller pair 80 to rotate in the direction for discharging the paper sheet from the switchback unit 8. In addition, the controller 1 controls the third conveyor roller pair 90 (third conveying motor) to rotate so that the paper sheet can join the conveying path of the first conveyor 5.

In order to start printing the second side, the controller 1 controls the first conveyor 5 to convey the paper sheet to the image former 6 (Step #315). The paper sheet, whose front and rear edges are reversed and front and back sides are reversed from those when printing the first side, is conveyed. When the switched-back paper sheet reaches the image former 6, the controller 1 controls each head 60 to perform ink ejection on the basis of image data for ink ejection of the second side (Step #316). After each line head 60 performs ink ejection, printing (drawing) on the second side of the paper sheet is completed.

Further, the controller 1 controls the second conveyor 7 to convey the paper sheet to the discharge tray 73 (Step #317). In a short time, the paper sheet after duplex printing is discharged onto the discharge tray 73. Next, the controller 1 checks whether or not the print job is completed (Step #318). In other words, the controller 1 checks whether or not the duplex printing to be performed according to the print job has been finished. When the print job is completed (Yes in Step #318), this flow is finished (END). When the print job is not completed (No in Step #318), the flow returns to Step #31.

In this way, the image forming apparatus (printer 100) according to the embodiment includes the line head 60, the first conveyor 5 (first conveyor roller pairs 51), the switchback unit 8 (switchback roller pair 80), the second conveyor 7 (second conveyor roller pair 70), the third conveyor 9 (third conveyor roller pair 90), and the controller 1. The line head 60 includes the nozzle for ejecting ink to the conveyed paper sheet. The line head 60 is fixed. The first conveyor 5 includes the first conveyor roller pairs 51. The first conveyor 5 conveys the paper sheet to the line head 60. The first conveyor 5 conveys the paper sheet in such a manner that the nozzle faces the paper sheet with the interval W therebetween. The switchback unit 8 includes the switchback roller pair 80. The switchback unit 8 reverses front and back sides of the paper sheet and reverses front and rear edges of the paper sheet for duplex printing. The second conveyor 7 conveys the paper sheet printed by the line head 60 to the switchback unit 8. The third conveyor 9 conveys the paper sheet switched back by the switchback unit 8. The third conveyor 9 returns the paper sheet to the first conveyor 5 on the upstream side of the line head 60. A plurality of the line heads 60 are disposed for individual ink colors. The ink colors include, at least, cyan, magenta, yellow, and black. In duplex printing, the controller 1 sets one of the front and back sides as the first side and sets the other side as the second side. The controller 1 starts printing the first side first and prints the second side after the first side is printed. On the basis of the image data of the first side used for printing the first side, the controller 1 checks specific area ink quantity as ink quantity to be ejected to the specific area on the first side. The controller 1 divides the specific area ink quantity by the predetermined solid printing ink quantity 21 so as to determine the ink quantity ratio. When the determined ink quantity ratio is larger than the predetermined reference ink quantity ratio 22, the controller 1 performs the black conversion process for pixels included in the conversion target range in the image data of the first side. The specific area is a strip-shaped area including a side edge on the upstream side in the conveying direction of the paper sheet on the first side out of the side edges facing each other in the sub-scanning direction, and having a width in the sub-scanning direction, which is a predetermined distance L1. The conversion target range is a range corresponding to the specific area in the image data of the first side. The black conversion process is a process of converting a pixel to which three color inks, i.e. cyan, magenta, and yellow inks are to be ejected into a pixel to which only black ink is to be ejected.

On the basis of the ink quantity ejected to the specific area, the ink quantity ratio can be determined. The specific area is an area on the upstream side in the sheet conveying direction (rear edge side in the sub-scanning direction) when printing the first side. When the paper sheet is switched back for duplex printing (when printing the second side), the specific area becomes the downstream side in the sheet conveying direction (front edge side in the sub-scanning direction). In other words, the specific area is a part that reaches first the line head 60 when printing the second side. Further, by comparison between the determined ink quantity ratio and the reference ink quantity ratio 22, it can be determined whether or not curl in the specific area is large when printing the second side. In other words, in a second pass (when the paper sheet passes below the line head 60), it can be determined whether or not curl is large at the front edge of the paper sheet to be printed on the second side (downstream side in the conveying direction).

When printing the second side, when it is predicted that curl in the specific area is large, the black conversion process can be performed. The black conversion process can reduce curl amount in the specific area when printing the second side (in the second pass). As the curl amount can be reduced, paper sheet jamming at the line head 60 can be prevented. In addition, it is not required to increase the number of print passes for reducing the curl. In duplex printing, paper sheet jamming at the head can be prevented while maintaining productivity.

The reference ink quantity ratio 22 is an ink quantity ratio when the paper sheet curl amount becomes the interval W between the line head 60 and the conveyor belt 56. When the determined ink quantity ratio is the reference ink quantity ratio 22 or less, the controller 1 does not perform the black conversion process for pixels included in the conversion target range. When the curl amount is such a degree that paper sheet jamming does not occur at the line head 60, it is possible to avoid performing the black conversion process. The black conversion process can be performed only in cases where curl occurs in such a degree that paper sheet jamming occurs when printing the second side for duplex printing (in the second pass).

The controller 1 determines the front side ink quantity to be ejected to the front side edge area F1 on the front side. The controller 1 determines the back side ink quantity to be ejected to the back side edge area F2 on the back side as a backside area of the front side edge area F1. When the front side ink quantity is the back side ink quantity or less, the controller 1 sets the front side as the first side and sets the back side as the second side. When the front side ink quantity is more than the back side ink quantity, the controller 1 sets the back side as the first side and sets the front side as the second side. The front side edge area F1 is a strip-shaped area including a side edge on the upstream side in the sheet conveying direction when printing the front side out of side edges facing each other in the sub-scanning direction, and having a width in the sub-scanning direction, which is a predetermined distance L1. One of the front and back sides, which requires less ink used for the area corresponding to the specific area, can be set as the first side. When printing the second side for duplex printing (in the second pass), it is possible to start printing first the side having less curl at the edge on the downstream side in the sheet conveying direction (front edge side in the sub-scanning direction).

The conveying rotation body 50 is disposed between the line head 60 on the most upstream side in the sheet conveying direction and the first conveyor roller pair 51 on the most downstream side in the sheet conveying direction. The predetermined distance L1 is a sheet conveying distance between the conveying rotation body 50 and the line head 60 on the most upstream side in the sheet conveying direction. The conveying rotation body 50 contacts the paper sheet. After the paper sheet passes the conveying rotation body 50, there is no member that presses the paper sheet. As a result, after the paper sheet passes the nip of the conveying rotation body 50, curl at the edge of the paper sheet becomes obvious (appears again). On the basis of the part curling after passing the conveying rotation body 50 closest to the line head 60 until reaching the line head 60, it is possible to determine the widths of the specific area, the front side edge area F1, and the back side edge area F2 in the sub-scanning direction.

The controller 1 may convert every pixel in the conversion target range, to which three color inks, i.e. cyan, magenta, and yellow inks are to be ejected, into a pixel to which only black ink is to be ejected. It is possible to reduce quantity of ink to be ejected to the specific area on the first side to the least. It is possible to reduce curl in the specific area as much as possible.

The controller 1 may convert pixels in the conversion target range, to which three color inks, i.e. cyan, magenta, and yellow inks are to be ejected, into pixels to which only black ink is to be ejected, so that the ink quantity ratio becomes the reference ink quantity ratio 22 or smaller. When printing the second side for duplex printing (in the second pass), curl at the edge on the downstream side in the sheet conveying direction (front edge side in the sub-scanning direction) can be reduced to an extent that paper sheet jamming does not occur. In addition, the number of pixels for which the black conversion process is performed can be reduced as much as possible.

The controller 1 may convert a predetermined conversion number of pixels in the conversion target range, to which three color inks, i.e. cyan, magenta, and yellow inks are to be ejected, into pixels to which only black ink is to be ejected. When printing the second side for duplex printing (in the second pass), curl can be reduced to an extent that paper sheet jamming does not occur at the line head 60. It is possible to perform the black conversion process for a certain number of pixels.

When the black conversion process is performed, the controller 1 determines the ink quantity after conversion as ink quantity to be ejected to the specific area, on the basis of the image data of the first side after the conversion. The controller 1 divides the determined ink quantity after conversion by the solid printing ink quantity 21 so as to calculate the ink quantity ratio after conversion. When the determined ink quantity ratio after conversion is larger than the reference ink quantity ratio 22, the controller 1 allows the paper sheet after printing one side to wait at the switchback unit 8 (switchback roller pair 80) for predetermined wait time 23. As elapsed time from ink ejection becomes longer, the curl amount becomes smaller in general. After the black conversion process is performed, it may still occur that ink is ejected to the specific area on the first side to an extent that paper sheet jamming occurs at the line head 60. In this case, the paper sheet can wait at the switchback unit 8. When printing the second side for duplex printing (in the second pass), it is possible to allow the paper sheet to enter below the line head 60 after reducing curl amount at the edge on the downstream side in the sheet conveying direction (front edge side in the sub-scanning direction).

In the case of printing a plurality of paper sheets successively, when the front side of the first sheet is set as the first side, the controller 1 sets the front side of every page as the first side. When the back side of the first sheet is set as the first side, the controller 1 sets the back side of every page as the first side. A relationship between front and back sides of the printed paper sheet can be unified for all pages.

(Variations)

Next, with reference to FIGS. 11 to 17, one example of an image forming apparatus according to a variation is described. Also in this variation, the printer 100 is exemplified as the image forming apparatus and is described. The image forming apparatus according to the variation has a similar structure to the image forming apparatus according to the embodiment. In other words, the same hardware can be used. The same name and the same numeral of each member as those in the embodiment are used in the following description.

(Setting of First and Second Sides in Duplex Printing)

First, setting of the first and second sides in the variation is described. In duplex printing, odd pages in the print data are printed on the front sides. In addition, even pages (odd pages on the front sides plus one page) in the print data are printed on the back sides. In duplex printing, the controller 1 sets one of the front and back sides of pages to be printed as the first side. The controller 1 sets the other side as the second side. In other words, the controller 1 sets one of the odd page and the even page next to the odd page as the first side and sets the other page as the second side.

In duplex printing, the controller 1 starts printing the first side first. Here, in a job of performing duplex printing a plurality of paper sheets successively, when the paper sheets of the printed matter discharged onto the discharge tray 73 have sorted front and back sides and are stacked in order from the first page, it is not required to sort the paper sheets of the printed matter.

On the other hand, in printing, the controller 1 allows the paper sheets to pass below the line head 60. Further, the printer 100 of the variation has two types of duplex printing. One type is jam prevention printing (details thereof are described later). The other type is normal duplex printing (details thereof are described later).

The jam prevention printing according to the variation is a print process for eliminating paper sheet jamming at the line head 60 similarly to the embodiment. In the jam prevention printing according to the variation, printing of a side to be printed first (the first side) is divided into two times of printing. This point is different from the embodiment. In the jam prevention printing, the switchback is performed two times. In addition, the paper sheet passes the line head 60 three times. In contrast, in the normal duplex printing, the number of passes is at least two. In the normal duplex printing, the number of switchbacks is at least one time.

In order to avoid necessity of sorting the printed matter after duplex printing, it is preferred that the first page is discharged first onto the discharge tray 73. In addition, it is preferred that the paper sheets are discharged with odd pages facing down on the discharge tray 73.

Therefore, in the duplex printing according to the variation, the controller 1 controls to print the first paper sheet (page) first. For instance, the controller 1 controls to print odd pages on one sides of the paper sheets and to print next pages to the odd pages (even pages) on the other sides. For instance, the first and second pages are printed on the first paper sheet. The third and fourth pages are printed on the next paper sheet.

The printer 100 of the variation may sometimes perform the jam prevention printing. At this time, the printer 100 can set the front side (odd page) as the first side. When the front side is set as the first side, after the two times of switchback in the jam prevention printing, the paper sheet with the front side facing up passes the line head 60 in the third pass. The second conveyor 7 discharges the paper sheet onto the discharge tray 73 with the front and back sides reversed from those when passing the line head 60. Therefore, the paper sheet is discharged with the front side facing down onto the discharge tray 73 (face down). In this way, in duplex printing, the controller 1 may start printing the front side (odd page) first.

However, when the front side is set as the first side, in the normal duplex printing, when the paper sheet is discharged onto the discharge tray 73 just after the duplex printing is completed (after the second side has been printed entirely), the paper sheet is discharged with the back side facing down (with the front side facing up). Therefore, when the front side is set as the first side, in the normal duplex printing, after the second side has been printed, the controller 1 controls the switchback unit 8 to perform switchback of the paper sheet. Further, the controller 1 controls the third conveyor 9 and the first conveyor 5 to allow the paper sheet to pass the line head 60 again. After that, the controller 1 controls the second conveyor 7 to discharge the paper sheet onto the discharge tray 73. In this way, the order of pages and the front and back sides of the paper sheets discharged onto the discharge tray 73 are sorted.

Note that in the normal duplex printing, the back side may be set as the first side. When the back side is set as the first side, after the switchback one time in the normal duplex printing, the paper sheet passes the line head 60 with the front side facing up in the second pass. The second conveyor 7 discharges the paper sheet onto the discharge tray 73 with reversing the front and back sides of the paper sheet, and hence the paper sheet can be discharged onto the discharge tray 73 with the front side facing down.

It is possible to perform the jam prevention printing with setting the back side as the first side. In this case, when the paper sheet is discharged onto the discharge tray 73 just after the duplex printing is completed (after the first side has been printed entirely), the paper sheet is discharged with the back side facing down (with the front side facing up). Therefore, in the jam prevention printing with setting the back side as the first side, the controller 1 controls the switchback unit 8 to perform switchback of the paper sheet after the first side has been printed entirely. Further, the controller 1 controls the third conveyor 9 and the first conveyor 5 to allow the paper sheet to pass the line head 60 again. After that, the controller 1 controls the second conveyor 7 to discharge the paper sheet onto the discharge tray 73. The number of passes in the jam prevention printing becomes four. Thus, the front and back sides and the order of pages of the paper sheets discharged onto the discharge tray 73 are sorted.

In this way, in duplex printing, the controller 1 may start printing with setting the back side (even page) as the first side. In the following description, in consideration of the jam prevention printing, an example in which the front side (a side on which an odd page is printed) is set as the first side is described.

(Determination of Duplex Printing to be Performed)

Figure 11:
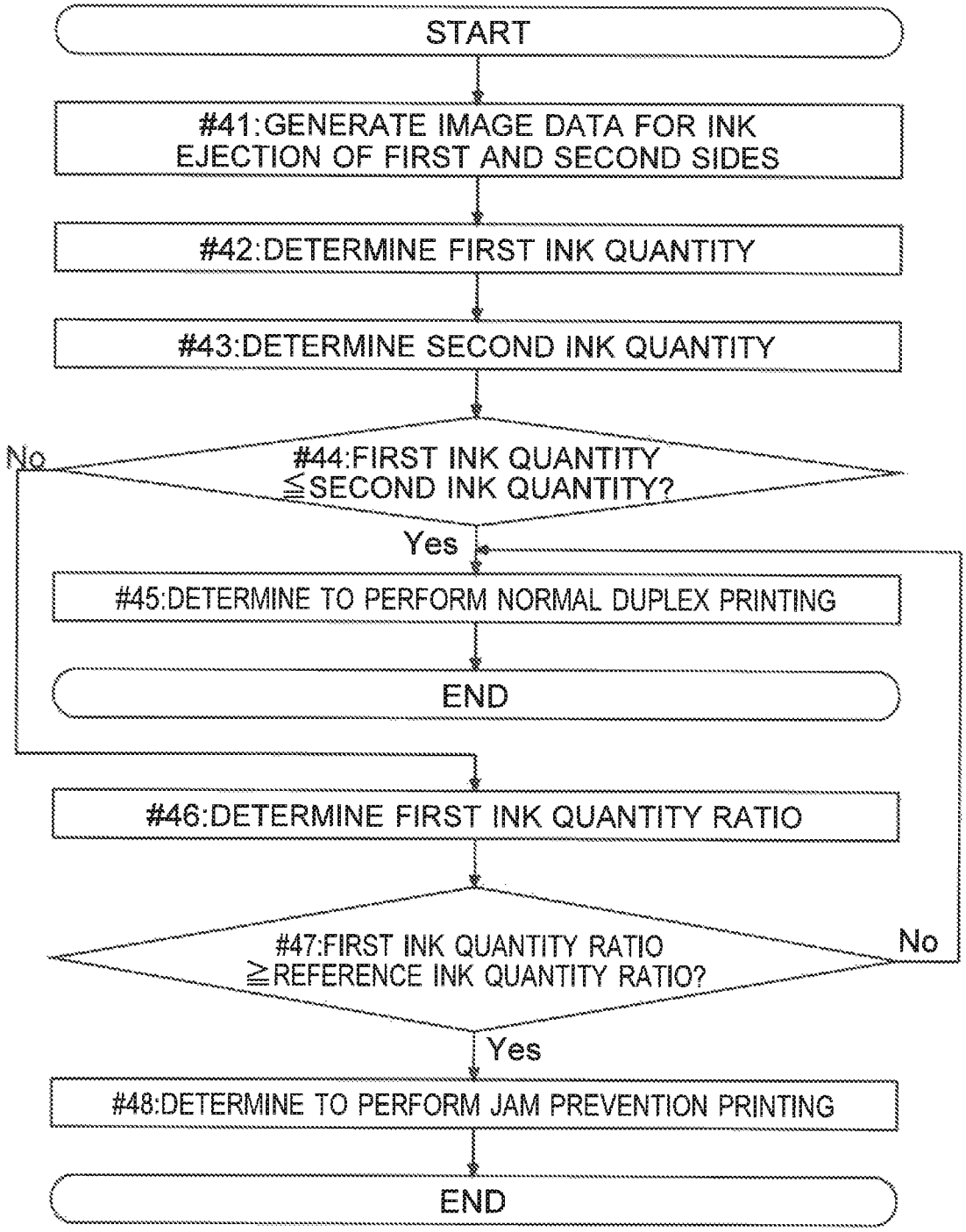
FIG. 11 is a diagram showing an example of type determination of duplex printing performed by the printer according to a variation example of the present disclosure.
Figure 12:
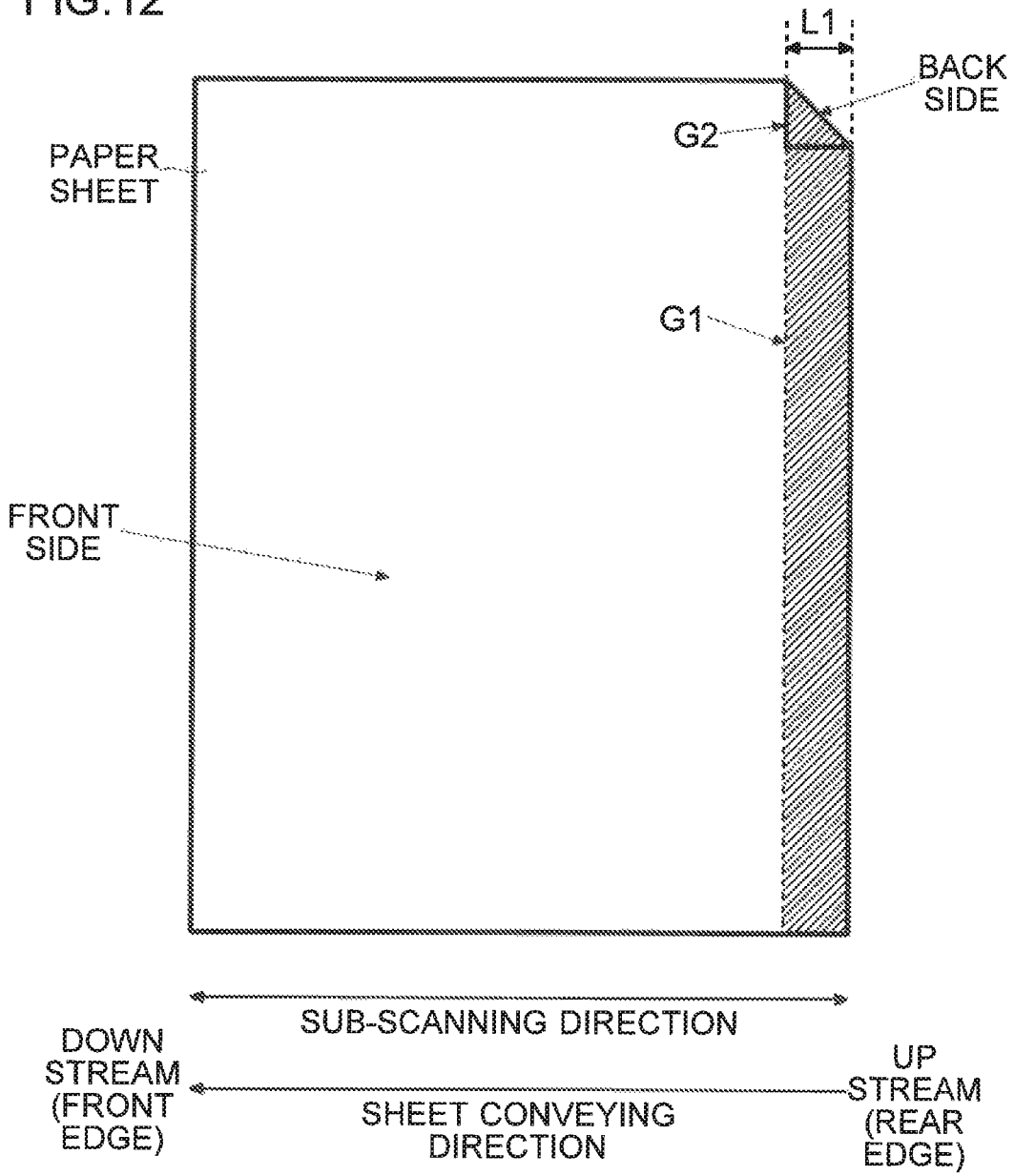
FIG. 12 is a diagram showing an example of first and second areas according to the variation example.
Figure 13:
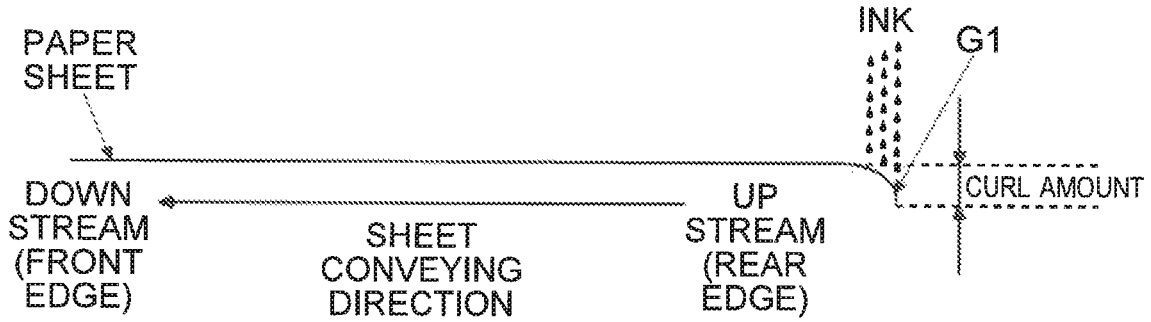
FIG. 13 is a diagram showing an example of paper sheet curl.

Next, with reference to FIGS. 11 to 13, one example of a flow of determining a type of duplex printing to be performed by the printer 100 according to the variation is described. In this variation, the controller 1 determines one of the jam prevention printing and the normal duplex printing as the duplex printing to be performed on the paper sheet. In the variation, the controller 1 performs this determination for each of the paper sheets. When performing duplex printing a plurality of paper sheets successively, the controller 1 determines which one of duplex printing should be performed for each (one page) of the paper sheets.

The controller 1 generates image data for ink ejection of the first and second sides on the basis of the received print data (Step #41). The duplex printing uses data of the front page (odd page) described in page description language for the next duplex printing and data of the back page (front odd page plus one page) described in page description language in the print data. The controller 1 (the image processing circuit 12) generates front and back print image data (raster data). On the basis of the print image data, the controller 1 generates front and back image data for ink ejection. In case of color printing, the controller 1 generates C, M, Y, and Bk image data for ink ejection of the front side. In addition, the controller 1 generates C, M, Y, and Bk image data for ink ejection of the back side, too.

The controller 1 determines first ink quantity (Step #42). The controller 1 determines the first ink quantity on the basis of image data to be used for printing the first side (image data for ink ejection of the first side). The first ink quantity is ink quantity to be ejected to a first area G1 on the first side.

As shown in FIG. 5, the first area G1 includes the side edge on the upstream side in the sheet conveying direction (rear edge side) out of the side edges facing each other in the sub-scanning direction. The upstream side in the sheet conveying direction (rear edge side) is the upstream side when printing the first side. The first area G1 has a width in the sub-scanning direction, which is the predetermined distance L1. The first area G1 is a strip-shaped area.

The predetermined distance L1 is the same as that in the embodiment. The predetermined distance L1 may be the sheet conveying distance between the conveying rotation body 50 and the line head 60 on the most upstream side.

Next, the controller 1 determines second ink quantity (Step #43). The controller 1 determines the second ink quantity on the basis of image data to be used for printing the second side (image data for ink ejection of the second side). The second ink quantity is ink quantity to be ejected to a second area G2 on the second side. As shown in FIG. 12, the second area G2 is a backside area of the first area G1. The first area G1 and the second area G2 have the same area size.

Calculation of the first ink quantity and the second ink quantity is described. First, also in the printer 100 according to the variation, quantity of ink to be ejected to one pixel is determined for each color. In addition, in the printer 100, the quantity of ink to be ejected to one pixel is the same (or may be different) among colors. For instance, the quantity of ink to be ejected to one pixel is approximately 5 to 7.5 picolitters for each color.

The controller 1 counts the number of pixels to eject ink for each color in the area corresponding to the first area G1 in the image data for ink ejection of the first side. The controller 1 determines the number of pixels to eject ink for each of cyan, yellow, magenta, and black inks. The controller 1 determines the sum of the numbers of pixels of individual colors. The controller 1 multiplies the quantity of ink to be ejected to one pixel of one color and the determined sum so as to calculate the first ink quantity (Step #42)

In addition, the controller 1 counts the number of pixels to eject ink for each color in the area corresponding to the second area G2 in the image data for ink ejection of the back side. The controller 1 determines the number of pixels to eject ink for each of cyan, yellow, magenta, and black inks. The controller 1 determines the sum of the numbers of pixels of individual colors. The controller 1 multiplies the quantity of ink to be ejected to one pixel of one color and the determined sum so as to calculate the second ink quantity (Step #43).

The controller 1 checks whether or not the first ink quantity is the second ink quantity or less (Step #44). When the first ink quantity is the second ink quantity or less (Yes in Step #44), the controller 1 determines to perform the normal duplex printing (Step #45). After Step #45, setting of type of the duplex printing on the paper sheet is completed (END).

On the contrary, when the first ink quantity is more than the second ink quantity (No in Step #44), the controller 1 determines a first ink quantity ratio (Step #46). The controller 1 divides the determined first ink quantity by the solid printing ink quantity 21 determined in advance so as to calculate the first ink quantity ratio. The storage medium 2 stores the solid printing ink quantity 21 in a nonvolatile manner (see FIG. 1). The controller 1 performs the calculation using the solid printing ink quantity 21 stored in the storage medium 2.

The solid printing ink quantity 21 in the variation is ink quantity when ejecting all color inks to all pixels in the first area G1 or the second area G2. In other words, the solid printing ink quantity 21 is ink consumption quantity when ejecting C, M, Y, and Bk inks to all pixels in the first area G1 or the second area G2. The number of all pixels in the first area G1 or the second area G2, ink ejection quantity for one color and one pixel, and 4 (4 colors) are multiplied, and thus the solid printing ink quantity 21 can be calculated (ink quantity 400%). Each ink quantity ratio indicates a ratio of ink quantity in the first area G1 or the second area G2 to ink quantity when performing 4-color solid printing.

Further, the controller 1 checks whether or not the first ink quantity ratio is the reference ink quantity ratio 22 or larger (Step #47). The reference ink quantity ratio 22 is an ink quantity ratio when the paper sheet curl amount becomes the same as the interval W between the line head 60 and the conveyor belt 56. The reference ink quantity ratio 22 is determined in advance. This point is the same as the embodiment. The controller 1 refers to the reference ink quantity ratio 22 stored in the storage medium 2 in a nonvolatile manner.

When the first ink quantity is more than the second ink quantity and when the determined first ink quantity ratio is the reference ink quantity ratio 22 or larger (Yes in Step #47), the controller 1 determines to perform the jam prevention printing (Step #48). After Step #48, setting of type of the duplex printing on the paper sheet is completed (END). Even when the first ink quantity is more than the second ink quantity, when the determined first ink quantity ratio is the reference ink quantity ratio 22 or smaller (No in Step #47), the controller 1 determines to perform the normal duplex printing (Step #45).

Here, with reference to FIG. 13, paper sheet curl in the printer 100 of the variation is described. In the paper sheet, a part that absorbed ink is bulged. When expansion rate of paper fiber is different between one side and the other side of the paper sheet, the paper sheet is curled. FIG. 13 shows an example in which ink is ejected to the first area G1 on the upper surface. For instance, when ink is ejected to the upper surface on the upstream side in the sheet conveying direction, the upstream side edge (first area G1) of the paper sheet is curled (curved) downward.

As shown in FIG. 13, the curl amount is a lift amount (height) of the paper sheet edge. It can also be said that the curl amount is a distance between the paper sheet edge and the horizontal surface in the vertical direction when the paper sheet is placed on the horizontal surface with the first area G1 facing back (in the same manner as described above with reference to FIG. 8). Note that the reference ink quantity ratio 22 according to the variation is the same as the reference ink quantity ratio 22 according to the embodiment. The above description with reference to FIG. 9 can be incorporated. Here, the description is omitted.

When the first ink quantity ratio is smaller than the reference ink quantity ratio 22, even when the entire first area G1 on the first side is printed in the first pass, the paper sheet is not jammed at the line head 60. It is not required to divide ink ejection to the first side into a plurality of times of ejection. Therefore, when the first ink quantity ratio is smaller than the reference ink quantity ratio 22, the controller 1 determines to perform the normal duplex printing.

Note that it may be possible not to perform Step #46 and Step #47. In this case, when the first ink quantity is the second ink quantity or less (Yes in Step #44), the controller 1 determines to perform the normal duplex printing. When the first ink quantity is more than the second ink quantity (No in Step #44), the controller 1 determines to always perform the jam prevention printing.

In addition, it may be also possible that the controller does not check whether or not the first ink quantity is the second ink quantity or less (does not perform Step #44). It may be also possible that when the first ink quantity ratio is larger than the reference ink quantity ratio 22, the controller 1 determines to perform the jam prevention printing. In addition, it may be also possible that when the first ink quantity ratio is the reference ink quantity ratio 22 or smaller, the controller 1 determines to perform the normal duplex printing.

(Normal Duplex Printing)

Figure 14:
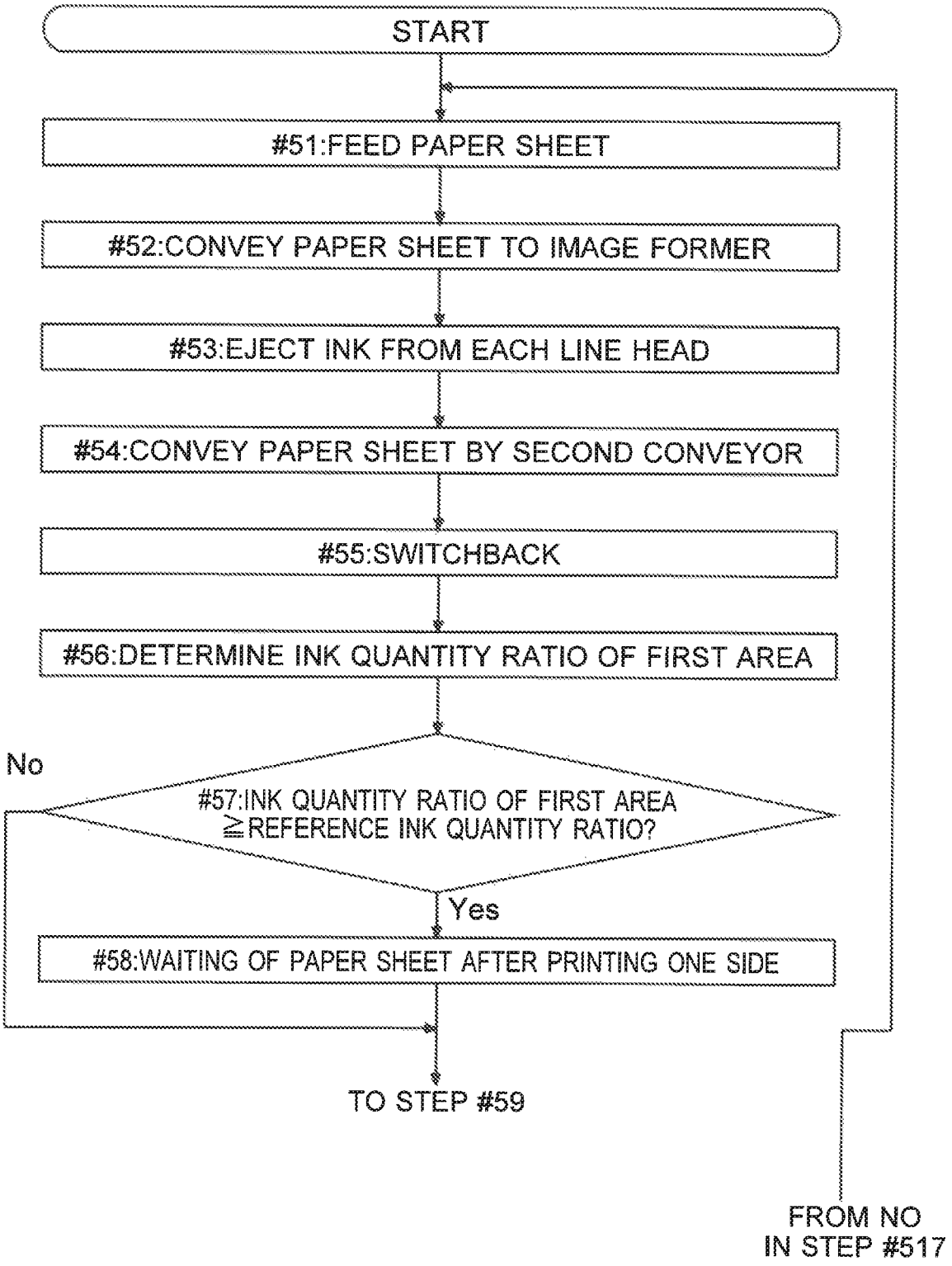
FIG. 14 is a diagram showing an example of a process of normal duplex printing by the printer according to the variation example.
Figure 15:
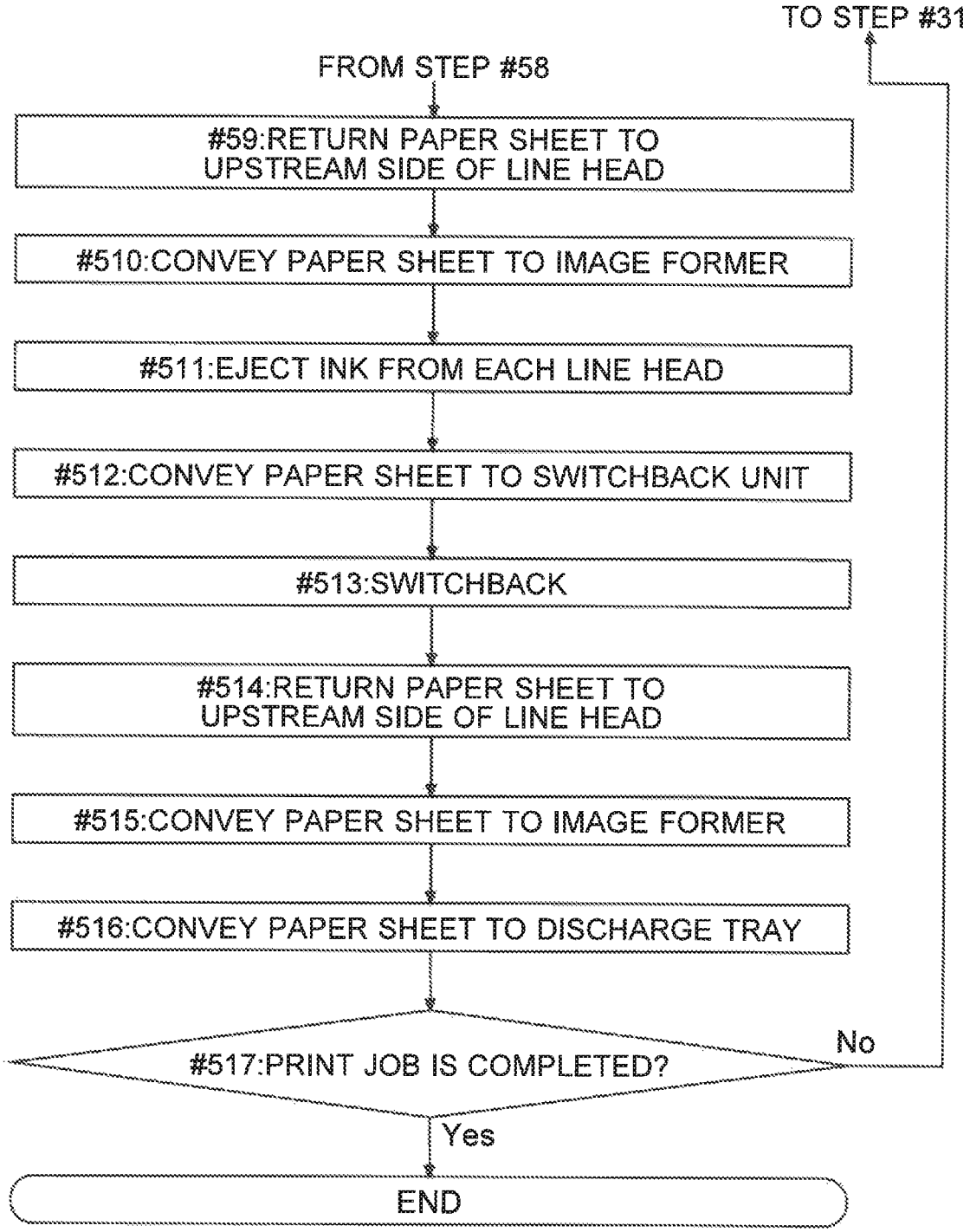
FIG. 15 is a diagram showing the example of the process of normal duplex printing by the printer according to the variation example.

Next, with reference to FIGS. 14 and 15, one example of the normal duplex printing process by the printer 100 according to the variation is described. After setting the first and second sides, the controller 1 controls the sheet feeder 4*a* to feed one paper sheet (Step #51). In this way, the paper sheet is fed from the sheet feeder 4*a*. Until the print job of the duplex printing is completed, the paper sheets are fed repeatedly.

Next, the controller 1 controls the first conveyor 5 to convey the paper sheet to the image former 6 (Step #52). When the paper sheet reaches the image former 6, the controller 1 controls each head 60 to perform ink ejection on the basis of image data for ink ejection of the first side (Step #53). When performing the normal duplex printing, the controller 1 controls the line head 60 to perform printing the entire first side. The controller 1 controls to eject the first ink quantity of ink to the first area G1 Printing (drawing) on one side (first side) of the paper sheet is completed.

Further, the controller 1 controls the second conveyor 7 to convey the paper sheet to the switchback unit 8 (Step #54). The controller 1 performs the same process as Step #39. As a result, the paper sheet is conveyed in the direction B in FIG. 2.

The controller 1 controls the switchback unit 8 to perform the switchback operation (Step #55). The controller 1 controls the switchback unit 8 to perform the same operation as Step #310 in FIG. 6. In this way, in the following conveyance, an edge portion having the first area G1 and the second area G2 of the paper sheet becomes the downstream side in the sheet conveying direction (front edge side). When the paper sheet is sent back to the image former 6, the edge portion having the first area G1 and the second area G2 enters first to the line head 60 (the interval W between the nozzle and the conveyor belt 56).

Further, the controller 1 determines ink quantity ratio of the first area G1 (Step #56). The ink quantity to be ejected to the first area G1 (first ink quantity) is divided by the solid printing ink quantity 21, and thus the ink quantity ratio of the first area G1 is calculated. In normal duplex printing, the ink quantity to be ejected to the first area G1 may become large. For instance, even when the first ink quantity is the second ink quantity or less, when both the first ink quantity and the second ink quantity are relatively large, the ink quantity to be ejected to the first area G1 may become large.

The controller 1 checks whether or not the ink quantity ratio of the first area G1 is the reference ink quantity ratio 22 or larger (Step #57). When the ink quantity ratio of the first area G1 is the reference ink quantity ratio 22 or larger (Yes in Step #57), the controller 1 allows the paper sheet after printing one side (paper sheet after passing the line head 60 one time) to wait at the switchback unit 8 for a predetermined wait time 23 (Step #58).

There is a tendency that as elapsed time from ink ejection becomes longer, the curl amount at the paper sheet edge becomes smaller (see FIG. 10). By temporarily stopping conveyance after ink ejection to the first side (first area G1), paper sheet jamming at the line head 60 may be prevented. The wait time 23 in the variation may be the same as the wait time 23 in the embodiment described above.

After waiting the wait time 23 (Step #58), the controller 1 returns the switched-back paper sheet (after printing one side) to the upstream side of the line head 60 (Step #59). On the contrary, when the ink quantity ratio of the first area G1 is smaller than the reference ink quantity ratio 22 (No in Step #57), after the switchback is completed, the controller 1 soon returns the switched-back paper sheet (after printing one side) to the upstream side of the line head 60 (Step #59). The controller 1 controls the second switching guide 72 to swing so as to guide the paper sheet to the first conveyor 5 (upstream of the image former 6). In addition, the controller 1 controls the switchback roller pair 80 to rotate in the direction discharging the paper sheet from the switchback unit 8 (reverse rotation). In addition, the controller 1 controls the third conveyor roller pair 90 (third conveying motor) to rotate so that the paper sheet can join the conveying path of the first conveyor 5.

In order to start printing the second side, the controller 1 controls the first conveyor 5 to convey the paper sheet to the image former 6 (Step #510). The front and rear edges are reversed from those in printing the first side. The front and back sides are reversed from those in printing the first side. When the switched-back paper sheet reaches the image former 6, the controller 1 controls each head 60 to perform ink ejection on the basis of the image data for ink ejection of the second side (Step #511). After each line head 60 performs ink ejection, printing (drawing) on the second side of the paper sheet is completed.

When the paper sheet is discharged in this state, it is discharged with the front side (odd page) facing up. Therefore, the controller 1 controls the second conveyor 7 to convey the paper sheet to the switchback unit 8 (Step #512). The controller 1 performs the same process as Step #39 or Step #54. As a result, the paper sheet is conveyed in the direction B in FIG. 2.

The controller 1 controls the switchback unit 8 to perform the switchback operation (Step #513). The controller 1 controls the switchback unit 8 to perform the same operation as Step #310 in FIG. 6 or Step #55.

The controller 1 returns the switched-back paper sheet (the paper sheet after printing one side) to the upstream side of the line head 60 (Step #514). The controller 1 controls the second switching guide 72 to swing so as to guide the paper sheet to the first conveyor 5 (upstream of the image former 6). In addition, the controller 1 controls the switchback roller pair 80 to rotate in the direction discharging the paper sheet to from the switchback unit 8 (reverse rotation). In addition, the controller 1 controls the third conveyor roller pair 90 (third conveying motor) to rotate, so that the paper sheet can join the conveying path of the first conveyor 5. Next, the controller 1 controls the first conveyor 5 to convey the paper sheet (Step #515). The controller 1 allows the paper sheet to pass the image former 6. As printing is completed, the controller 1 does not allow the line heads 60 to eject ink.

Further, the controller 1 controls the second conveyor 7 to convey again the switched-back paper sheet to the discharge tray 73 (Step #516). In a short time, the paper sheet after duplex printing is discharged onto the discharge tray 73. The paper sheet is discharged with the front side facing down. Next, the controller 1 checks whether or not the print job is completed (Step #517). In other words, the controller 1 checks whether or not the duplex printing to be performed according to the print job has been finished. When the print job is completed (Yes in Step #517), this flow is finished (END). When the print job is not completed (No in Step #517), the flow returns to Step #51.

(Jam Prevention Printing)

Figure 16:
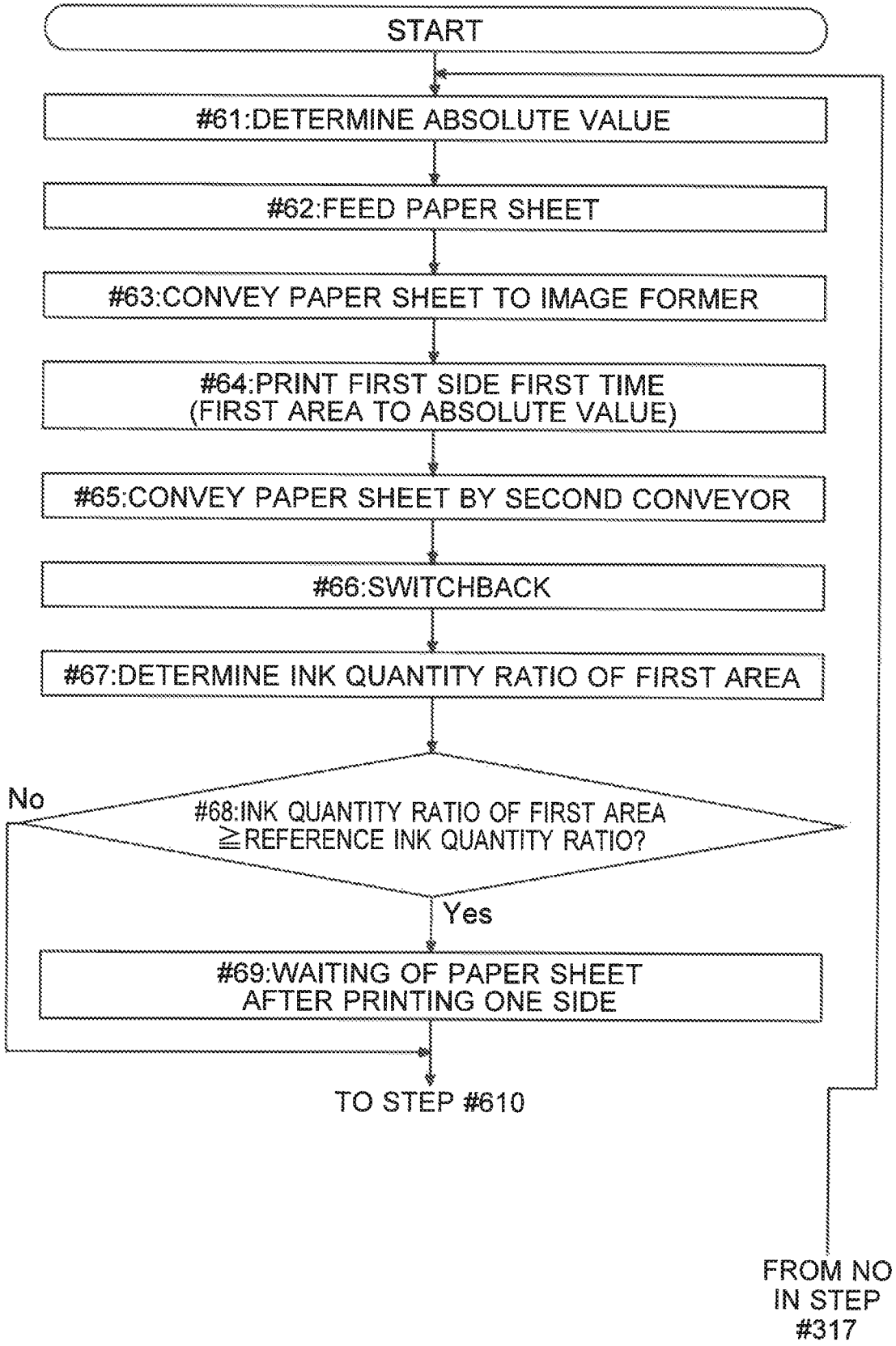
FIG. 16 is a diagram showing an example of a process of jam prevention printing by the printer according to the variation example.
Figure 17:
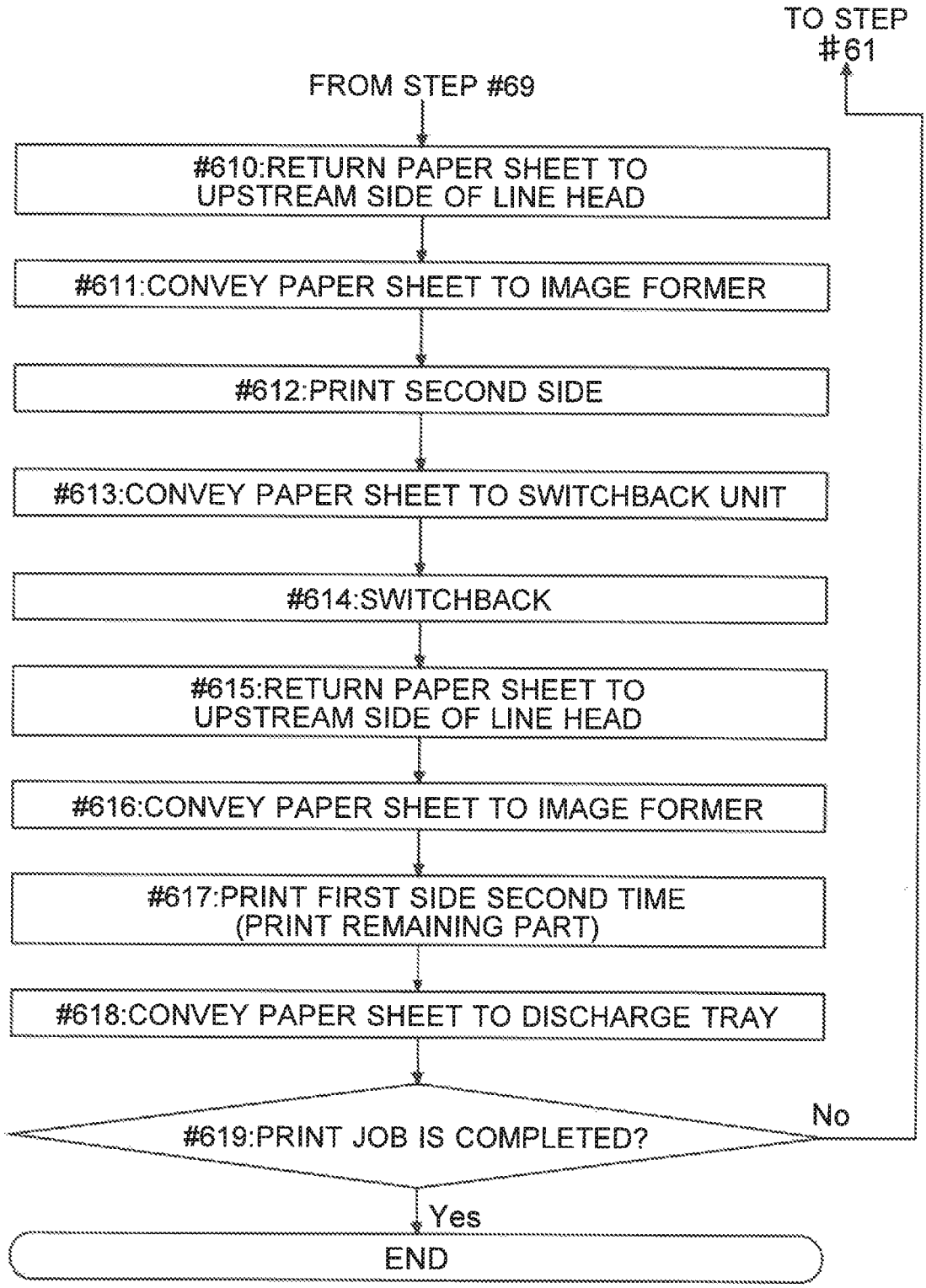
FIG. 17 is a diagram showing the example of the process of jam prevention printing by the printer according to the variation example.

Next, with reference to FIGS. 16 and 17, one example of the jam prevention printing process by the printer 100 according to the variation is described. When starting the jam prevention printing after setting the first and second sides, the controller 1 determines the absolute value of a difference between the first ink quantity and the second ink quantity for the paper sheet to be duplex printed (Step #61). For instance, when the first ink quantity is 100 and the second ink quantity is 70, the determined absolute value is 30.

The controller 1 controls the sheet feeder 4*a* to feed one paper sheet (Step #62). The paper sheet is fed from the sheet feeder 4*a*, Until the print job of the duplex printing is completed, the paper sheets are fed repeatedly. Next, the controller 1 controls the first conveyor 5 to convey the fed paper sheet to the image former 6 (Step #63).

When the paper sheet reaches the image former 6, the controller 1 controls the line head 60 to perform printing the first side first time on the basis of the image data for ink ejection of the first side (Step #64). At this time, the controller 1 controls the line head 60 to perform printing by the same ink quantity as the determined absolute value for the first area G1 on the first side.

In Step #64, the controller 1 may control the line head 60 to print the entire area other than the first area G1 on the first side. In addition, the controller 1 may control to print only the first area G1 in printing the first side first time. In this case, in printing the first side second time performed later, other area than the first area G1 on the first side is printed.

Further, the controller 1 controls the second conveyor 7 to convey the paper sheet to the switchback unit 8 (Step #65).

The controller 1 performs the same process as Step #39, Step #54, or Step #512. As a result, the paper sheet is conveyed in the direction B in FIG. 2.

Further, the controller 1 controls the switchback unit 8 to perform the switchback operation (Step #66). The controller 1 controls switchback unit 8 to perform the same operation as Step #310 in FIG. 6, Step #55, or Step #513. In this way, in the following conveyance, the edge portion having the first area G1 and the second area G2 of the paper sheet becomes the downstream side in the sheet conveying direction (front edge side). When the paper sheet is sent back to the image former 6, the edge portion having the first area G1 and the second area G2 first enters the line head 60 (the interval W between the nozzle and the conveyor belt 56).

Further, the controller 1 determines the ink quantity ratio of the first area G1 (Step #67). The controller 1 divides the ink quantity ejected actually to the first area G1 (absolute value) by the solid printing ink quantity 21, so as to calculate the ink quantity ratio of the first area G1 when printing the first side first time. Also in the jam prevention printing, the ink quantity to be ejected to the first area G1 may be large. For instance, when the first ink quantity is the second ink quantity or less, and when the difference between the first ink quantity and the second ink quantity is relatively large, the ink quantity to be ejected to the first area G1 when printing the first side first time may be large.

The controller 1 checks whether or not the ink quantity ratio of the first area G1 is the reference ink quantity ratio 22 or larger (Step #68). When the ink quantity ratio of the first area G1 is the reference ink quantity ratio 22 or larger (Yes in Step #68), the controller 1 allows the paper sheet after printing one side (the paper sheet after passing the line head 60 one time) to wait at the switchback unit 8 for the predetermined wait time 23 (Step #69).

After waiting the wait time 23 (Step #69), the controller 1 returns the switched-back paper sheet (after printing one side) to the upstream side of the line head 60 (Step #610). Alternatively, when the ink quantity ratio of the first area G1 is smaller than the reference ink quantity ratio 22 (No in Step #68), the controller 1 returns the switched-back paper sheet (after printing one side) to the upstream side of the line head 60 soon after the switchback is completed (Step #610). The controller 1 controls the second switching guide 72 to swing so as to guide the paper sheet to the first conveyor 5 (upstream of the image former 6). In addition, the controller 1 controls the switchback roller pair 80 to rotate in the direction discharging the paper sheet from the switchback unit 8 (reverse rotation). In addition, the controller 1 controls the third conveyor roller pair 90 (third conveying motor) to rotate, so that the paper sheet can join the conveying path of the first conveyor 5.

In order to start printing the second side, the controller 1 controls the first conveyor 5 to convey the paper sheet to the image former 6 (Step #611). The paper sheet, whose front and rear edges are reversed and front and back sides are reversed from those in printing the first side, is conveyed. When the switched-back paper sheet reaches the image former 6, the controller 1 controls each head 60 to perform printing (ink ejection) on the second side on the basis of the image data for ink ejection of the second side (Step #612). The controller 1 controls the line head 60 to perform printing the entire second side.

After each line head 60 performs ink ejection, printing (drawing) on the second side of the paper sheet is completed. By printing the second side, the second area G2 is printed. As ink is ejected to the second area G2 too, the second area G2 is also expanded. The expansion rate of the first area G1 becomes close to that of the second area G2. The curl amount does not become large.

Here, the first side still has a remaining part to be printed. Therefore, the controller 1 controls the second conveyor 7 to convey the paper sheet to the switchback unit 8 (Step #613). The controller 1 allows the paper sheet to enter the switchback unit 8. The controller 1 performs the same process as Step #39, Step #54, Step #512, or Step #65. As a result, the paper sheet is conveyed m the direction B in FIG. 2.

Further, the controller 1 controls the switchback unit 8 to perform the switchback operation (Step #614). The controller 1 performs the same process as Step #39, Step #54, Step #512, or Step #66.

The controller 1 returns the switched-back paper sheet (after printing one side) to the upstream side of the line head 60 (Step #615). The controller 1 controls the second switching guide 72 to swing so as to guide the paper sheet to the first conveyor 5 (upstream of the image former 6). The controller 1 controls the switchback roller pair 80 to rotate in the direction discharging the paper sheet from the switchback unit 8 (reverse rotation). The controller 1 controls the third conveyor roller pair 90 (third conveying motor) to rotate, so that the paper sheet can join the conveying path of the first conveyor 5.

Next, the controller 1 controls the first conveyor 5 to convey the paper sheet (Step #616). When the paper sheet reaches the image former 6, the controller 1 controls the line head 60 to perform printing the first side second time on the basis of the image data for ink ejection of the first side (Step #617). The controller 1 controls the line head 60 to perform printing the remaining part on the first side (printing of an unprinted part).

The controller 1 controls the line head 60 to print the unprinted part in the first area G1 on the first side. The controller 1 controls the line head 60 to perform ink ejection of ink quantity obtained by subtracting the absolute value from the first ink quantity. For other areas than the first area G1, the controller 1 controls the line head 60 to print the unprinted part.

Further, the controller 1 controls the second conveyor 7 to convey the switched-back paper sheet to the discharge tray 73 (Step #618). The duplex printed paper sheet is discharged onto the discharge tray 73 in a short time. The first side is the front side, and the switchback has been performed two times. Therefore, the paper sheet is discharged with the front side facing down. Next, the controller 1 checks whether or not the print job is completed (Step #619). In other words, the controller 1 checks whether or not the duplex printing to be performed according to the print job has been finished. When the print job is completed (Yes in Step #619), this flow is finished (END). When the print job is not completed (No in Step #619), the flow returns to Step #61.

In this way, the image forming apparatus (printer 100) according to the variation includes the line head 60, the first conveyor 5 (first conveyor roller pairs 51), the switchback unit 8 (switchback roller pair 80), the second conveyor 7 (second conveyor roller pair 70), the third conveyor 9 (third conveyor roller pair 90), and the controller 1. The line head 60 includes the nozzle for ejecting ink to the conveyed paper sheet. The line head 60 is fixed. The first conveyor 5 includes the first conveyor roller pairs 51. The first conveyor 5 conveys the paper sheet to the line head 60. The first conveyor 5 conveys the paper sheet in such a manner that the nozzle faces the paper sheet. The switchback unit 8 includes the switchback roller pair 80. The switchback unit 8 reverses front and back sides of the paper sheet and reverses front and rear edges of the paper sheet for duplex printing. The second conveyor 7 conveys the paper sheet printed by the line head 60 to the switchback unit 8. The third conveyor 9 conveys the paper sheet switched back by the switchback unit 8, and returns the paper sheet to the upstream side of the line head 60. In duplex printing, the controller 1 sets one of the front and back sides as the first side and sets the other side as the second side. The controller 1 starts printing the first side first. On the basis of the image data used for printing the first side, the controller 1 determines the first ink quantity as ink quantity to be ejected to the first area G1 on the first side. The controller 1 determines the second ink quantity as ink quantity to be ejected to the second area G2 as a backside area of the first area G1 on the second side. When the first ink quantity is more than the second ink quantity, the controller 1 controls to perform the jam prevention printing. When the first ink quantity is less than the second ink quantity, the controller 1 controls to perform the normal duplex printing. When performing the jam prevention printing, the controller 1 determines the absolute value of a difference between the first ink quantity and the second ink quantity. The controller 1 controls the line head 60 to perform printing of the first area G1 by the same ink quantity as the absolute value when printing the first side first time. The controller 1 controls the switchback unit 8 to switchback the paper sheet after printing the first side, so as to return the switched-back paper sheet to the upstream side of the line head 60. Next, the controller 1 controls the line head 60 to perform printing the entire second side. The controller 1 controls the switchback unit 8 to switchback the paper sheet after printing the second side, so as to return the switched-back paper sheet to the upstream side of the line head 60. Next, the controller 1 controls the line head 60 to perform printing the remaining part on the first side. The first area G1 is a strip-shaped area including a side edge on the upstream side in the conveying direction of the paper sheet when printing the first side, out of side edges facing each other in the sub-scanning direction, and having a width in the sub-scanning direction, which is a predetermined distance L1.

The jam prevention printing enables to divide the printing of the first side into two times of printing. Only in cases where there is high possibility of paper sheet jamming at the line head 60 due to curl, the jam prevention printing can be performed. In the jam prevention printing, in a first pass (pass of the paper sheet below the line head 60), a part on the first side is printed, the entire second side is printed in a second pass, and printing the entire first side is completed in a third pass. As only a part of the first area G1 is printed in the first pass, curl at the front edge of the paper sheet (the downstream side in the conveying direction) can be reduced in the second pass. Thus, paper sheet jamming hardly occurs. In the second pass, ink is ejected to the second area G2 too. Due to the ejection to the second side (second area G2), the edge on the second side is also bulged. As a result, curl at the paper sheet edge is reduced. In other words, in the third pass for duplex printing, curl at the edge on the downstream side in the sheet conveying direction (front edge side in the sub-scanning direction) is reduced. Therefore, paper sheet jamming at the line head 60 can be prevented in the second pass and in the third pass. It is not required to increase the number of passes to prevent paper sheet jamming. Thus, the number of print passes can be reduced. There is little reduction in productivity (the number of printed sheets per unit time).

When performing the normal duplex printing, the controller 1 controls to print the first side first. When printing the first side, the controller 1 controls the line head 60 to perform printing the entire first side. The controller 1 controls the switchback unit 8 (switchback roller pair 80) to perform the switchback of the paper sheet after printing the first side, and thus the switched-back paper sheet is sent back to the upstream side of the line head 60. Next, the controller 1 controls the line head 60 to perform printing the entire second side. When there is little possibility of paper sheet jamming, the entire first side can be printed in the first passing (pass) the line head 60. In addition, the entire second side can be printed in the second pass.

The controller 1 divides the determined first ink quantity by the solid printing ink quantity 21 determined in advance so as to determine the first ink quantity ratio. When the first ink quantity is more than the second ink quantity, and when the determined first ink quantity ratio is the predetermined reference ink quantity ratio 22 or larger, the controller 1 controls to perform the jam prevention printing. Even when the first ink quantity is more than the second ink quantity, when the determined first ink quantity ratio is smaller than the reference ink quantity ratio 22, the controller 1 performs the normal duplex printing. Only when there is a high probability of jamming of a curled paper sheet at the line head 60, the jam prevention printing can be performed.

When performing the duplex printing, the controller 1 divides the ink quantity ejected to the first area G1 by the solid printing ink quantity 21 so as to determine the ink quantity ratio of the first area G1. When the determined ink quantity ratio of the first area G1 is the reference ink quantity ratio 22 or more, the controller 1 allows the paper sheet, which has been printed on the first side first time and is on the way returning to the upstream side of the line head 60, to wait at the switchback unit 8 (switchback roller pair 80) for the predetermined wait time 23. As elapsed time from ink ejection becomes longer, the curl amount becomes smaller in general. When there is a high probability of paper sheet jamming at the line head 60 in consideration of the quantity of ink ejected to the first area G1, it is possible to allow the paper sheet to temporarily wait (stop) at the switchback unit 8. When printing the second side for duplex printing (in the second pass), curl at the edge on the downstream side in the sheet conveying direction (front edge side in the sub-scanning direction) can be reduced before the paper sheet enters below the line head 60.

The conveying rotation body 50 is disposed between the line head 60 on the most upstream side in the sheet conveying direction and the first conveyor roller pair 51 on the most downstream side in the sheet conveying direction. The predetermined distance L1 is the sheet conveying distance between the conveying rotation body 50 and the line head 60 on the most upstream side in the sheet conveying direction. The conveying rotation body 50 contacts the paper sheet. While contacting with the conveying rotation body 50, the paper sheet curl is suppressed. A part of the paper sheet, which has passed the pair of conveying rotation bodies 50 and is not pressed any more, is curled again. With this structure, the widths of the first area G1 and the second area G2 in the sub-scanning direction can be determined on the basis of the part curling after the paper sheet passes the conveying rotation body 50 closest to the line head 60 until it reaches the line head 60.

In the case of printing a plurality of paper sheets successively, when the controller 1 sets the front side of the first sheet as the first side, it sets the front side of every paper sheet as the first side. When the back side of the first sheet is set as the first side, the back side of every paper sheet is set as the first side. A relationship between front and back sides of the printed paper sheet can be unified for all paper sheets.

Although the variation of the present disclosure is described above, the scope of the present disclosure is not limited to this, and various modifications can be made within the scope of the present disclosure without deviating from the spirit thereof.

What is claimed is:

1. An image forming apparatus comprising:

a line head including a nozzle for ejecting ink to a conveyed paper sheet, the line head being fixed;

a first conveyor roller pair for conveying the paper sheet to the line head;

a conveyor belt for conveying the paper sheet in such a manner that the nozzle faces the paper sheet with an interval therebetween;

a switchback roller pair configured to reverse front and back sides of the paper sheet and to reverse front and rear edges of the paper sheet for duplex printing;

a second conveyor roller pair for conveying the paper sheet printed by the line head to the switchback roller pair;

a third conveyor roller pair for conveying the paper sheet switched back by the switchback roller pair so as to return the paper sheet to the first conveyor roller pair on upstream side of the line head; and a controller, wherein a plurality of the line heads are disposed for individual ink colors, which include cyan, magenta, yellow, and black at least, and wherein when performing duplex printing, the controller sets one of front and back sides as a first side and sets the other side as a second side, starts printing the first side first and prints the second side after the first side is printed, checks specific area ink quantity as ink quantity to be ejected to a specific area on the first side on the basis of image data of the first side used for printing the first side, determines an ink quantity ratio by dividing the specific area ink quantity by a predetermined solid printing ink quantity, and performs a black conversion process for pixels included in a conversion target range in the image data of the first side when the determined ink quantity ratio is larger than a predetermined reference ink quantity ratio, the specific area is a strip-shaped area including a side edge on upstream side in the conveying direction of the paper sheet on the first side, out of side edges facing each other in a sub-scanning direction, and having a width in the sub-scanning direction, which is a predetermined distance, the conversion target range is a range corresponding to the specific area in the image data of the first side, and the black conversion process is a process of converting a pixel to which three color inks, i.e. cyan, magenta, and yellow inks are to be ejected into a pixel to which only black ink is to be ejected.

2. The image forming apparatus according to claim 1, wherein the reference ink quantity ratio is an ink quantity ratio when a paper sheet curl amount becomes the interval, and when the determined ink quantity ratio is the reference ink quantity ratio or smaller, the controller does not perform the black conversion process for pixels included in the conversion target range.

3. The image forming apparatus according to claim 1, wherein the controller determines front side ink quantity to be ejected to a front side edge area on the front side, the controller determines back side ink quantity to be ejected to a back side edge area as a backside area of the front side edge area on the back side, when the front side ink quantity is the back side ink quantity or less, the controller sets the front side as the first side and sets the back side as the second side, when the front side ink quantity is more than the back side ink quantity, the controller sets the back side as the first side and sets the front side as the second side, and the front side edge area is a strip-shaped area including a side edge on the upstream side in the sheet conveying direction when printing the front side, out of side edges facing each other in a sub-scanning direction, and having a width in the sub-scanning direction, which is the predetermined distance.

4. The image forming apparatus according to claim 1, wherein a conveying rotation body is disposed between the line head on the most upstream side in the sheet conveying direction and the first conveyor roller pair on the most downstream side in the sheet conveying direction, and the predetermined distance is a sheet conveying distance between the conveying rotation body and the line head on the most upstream side in the sheet conveying direction.

5. The image forming apparatus according to claim 1, wherein the controller converts every pixel to which three color inks, i.e. cyan, magenta, and yellow inks are to be ejected in the conversion target range into a pixel to which only black ink is to be ejected.

6. The image forming apparatus according to claim 1, wherein the controller converts pixels to which three color inks, i.e. cyan, magenta, and yellow inks are to be ejected in the conversion target range into pixels to which only black ink is to be ejected, so that the ink quantity ratio becomes the reference ink quantity ratio or smaller.

7. The image forming apparatus according to claim 1, wherein the controller converts a predetermined conversion number of pixels among pixels to which three color inks, i.e. cyan, magenta, and yellow inks are to be ejected in the conversion target range, into pixels to which only black ink is to be ejected.

8. The image forming apparatus according to claim 1, wherein when the black conversion process is performed, the controller determines ink quantity after conversion as ink quantity to be ejected to the specific area, on the basis of the image data of the first side alter the conversion, the controller divides the determined ink quantity after conversion by the solid printing ink quantity so as to determine an ink quantity ratio after conversion, and when the determined ink quantity ratio after conversion is larger than the reference ink quantity ratio, the controller allows the paper sheet after printing one side to wait at the switchback roller pair for a predetermined wait time.

9. The image forming apparatus according to claim 1, wherein in the case of printing a plurality of paper sheets successively, when the controller sets the front side of a first sheet as the first side, it sets the front side of every page as the first side, and when the controller sets the back side of the first sheet as the first side, it sets the back side of every page as the first side.

10. A method for controlling an image forming apparatus, the method comprising:

controlling a fixed line head to eject ink from a nozzle to a conveyed paper sheet;

controlling a first conveyor roller pair to convey the paper sheet to the line head;

controlling a conveyor belt to convey the paper sheet in such a manner that the nozzle faces the paper sheet with an interval therebetween;

controls a switchback roller pair to reverse front and back sides of the paper sheet and to reverse front and rear edges of the paper sheet for duplex printing;

controls to convey the paper sheet printed by the line head to the switchback roller pair;

controls to convey the paper sheet switched back by the switchback roller pair, so as to return the paper sheet to the first conveyor roller pair on upstream side of the line head;

disposing a plurality of the line heads for individual ink colors, including at least cyan, magenta, yellow, and black; and when performing duplex printing, setting one of front and back sides as a first side and sets the other side as a second side, starting printing the first side first and printing the second side after the first side is printed, checking specific area ink quantity as ink quantity to be ejected to a specific area on the first side on the basis of image data of the first side used for printing the first side, determining an ink quantity ratio by dividing the specific area ink quantity by a predetermined solid printing ink quantity, and performing a black conversion process for pixels included in a conversion target range in the image data of the first side when the determined ink quantity ratio is larger than a predetermined reference ink quantity ratio, wherein the specific area is a strip-shaped area including a side edge on upstream side in the conveying direction of the paper sheet on the first side, out of side edges facing each other in a sub-scanning direction, and having a width in the sub-scanning direction, which is a predetermined distance, the conversion target range is a range corresponding to the specific area in the image data of the first side, and the black conversion process is a process of converting a pixel to which three color inks, i.e. cyan, magenta, and yellow inks are to be ejected into a pixel to which only black ink is to be ejected.

11. An image forming apparatus comprising:

a line head including a nozzle for ejecting ink to a conveyed paper sheet, the line head being fixed;

a first conveyor roller pair for conveying the paper sheet to the line head;

a conveyor belt for conveying the paper sheet in such a manner that the nozzle faces the paper sheet with an interval therebetween;

a switchback roller pair configured to reverse front and back sides of the paper sheet and to reverse front and rear edges of the paper sheet for duplex printing;

a second conveyor roller pair for conveying the paper sheet printed by the line head to the switchback roller pair;

a third conveyor roller pair for conveying the paper sheet switched back by the switchback roller pair so as to return the paper sheet to the first conveyor roller pair on upstream side of the line head; and a controller, wherein when performing duplex printing, the controller sets one of front and back sides as a first side and sets the other side as a second side, starts printing the first side first, determines first ink quantity as ink quantity to be ejected to a first area on the first side on the basis of image data of the first side used for printing the first side, determines second ink quantity as ink quantity to be ejected to a second area as a backside area of the first area on the second side, controls to perform jam prevention printing when the first ink quantity is more than the second ink quantity, and controls to perform normal duplex printing when the first ink quantity is the second ink quantity or less, and when performing the jam prevention printing, the controller determines an absolute value of a difference between the first ink quantity and the second ink quantity, controls the line head to print the first area by the same ink quantity as the absolute value in printing the first side first time, controls the switchback roller pair to switchback the paper sheet after printing the first side so as to return the switched-back paper sheet to the upstream side of the line head, controls next the line head to print the entire second side, controls the switchback roller pair to switchback the paper sheet after printing the second side so as to return the switched-back paper sheet to upstream side of the line head, and controls next the line head to print the remaining area on the first side, and wherein the first area is a strip-shaped area including a side edge on upstream side in the conveying direction of the paper sheet when printing the first side out of side edges facing each other in the sub-scanning direction, and having a width in the sub-scanning direction, which is a predetermined distance.

12. The image forming apparatus according to claim 11, wherein when performing the normal duplex printing, the controller controls to print the first side first, controls the line head to print the entire first side in printing the first side, controls the switchback roller pair to switchback the paper sheet after printing the first side so as to return the switched-back paper sheet to the upstream side of the line head, and controls next the line head to perform printing the entire second side.

13. The image forming apparatus according to claim 11, wherein the controller divides the determined first ink quantity by a predetermined solid printing ink quantity so as to determine a first ink quantity ratio, controls to perform the jam prevention printing when the first ink quantity is more than the second ink quantity and when the determined first ink quantity ratio is the predetermined reference ink quantity ratio or larger, and controls to perform the normal duplex printing when the determined first ink quantity ratio is smaller than the reference ink quantity ratio even when the first ink quantity is more than the second ink quantity.

14. The image forming apparatus according to claim 13, wherein when performing the duplex printing, the controller divides ink quantity ejected to the first area by the solid printing ink quantity so as to determine an ink quantity ratio of the first area, and when the determined ink quantity ratio of the first area is the reference ink quantity ratio or larger, the controller allows the paper sheet, which has been printed on the first side first time and is on the way returning to the upstream side of the line head, to wait at the switchback roller pair for a predetermined wait time.

15. The image forming apparatus according to claim 11, wherein a conveying rotation body is disposed between the line head on the most upstream side in the sheet conveying direction and the first conveyor roller pair on the most downstream side in the sheet conveying direction, and the predetermined distance is a sheet conveying distance between the conveying rotation body and the line head on the most upstream side in the sheet conveying direction.

16. The image forming apparatus according to claim 11, wherein in the case of printing a plurality of paper sheets successively, when the controller sets the front side of a first sheet as the first side, it sets the front side of every page as the first side, and when the controller sets the back side of the first sheet as the first side, it sets the back side of every page as the first side.

* * * * *